US011806828B2

(12) United States Patent
Nakamura

(10) Patent No.: US 11,806,828 B2
(45) Date of Patent: Nov. 7, 2023

(54) POLISHING APPARATUS AND CALIBRATION METHOD

(71) Applicant: Ebara Corporation, Tokyo (JP)

(72) Inventor: Akira Nakamura, Tokyo (JP)

(73) Assignee: Ebara Corporation, Tokyo (JP)

( * ) Notice: Subject to any disclaimer, the term of this patent is extended or adjusted under 35 U.S.C. 154(b) by 1156 days.

(21) Appl. No.: 16/504,905

(22) Filed: Jul. 8, 2019

(65) Prior Publication Data

US 2020/0016722 A1 Jan. 16, 2020

(30) Foreign Application Priority Data

Jul. 13, 2018 (JP) ..... 2018-133604

(51) Int. Cl.
*B24B 37/013* (2012.01)
*B24B 49/04* (2006.01)
*B24B 49/10* (2006.01)

(52) U.S. Cl.
CPC ..... *B24B 37/013* (2013.01); *B24B 49/04* (2013.01); *B24B 49/105* (2013.01)

(58) Field of Classification Search
CPC ..... B24B 37/013; B24B 37/015; B24B 37/10; B24B 49/04; B24B 49/045; B24B 49/10; B24B 49/105; B24B 49/14
USPC ..... 451/5, 6, 7, 10, 11, 41, 285, 287
See application file for complete search history.

(56) References Cited

U.S. PATENT DOCUMENTS 7,198,545 B1 4/2007 Korovin et al.
7,508,201 B2 3/2009 Tada et al.
7,670,206 B2 * 3/2010 Togawa ..... B24B 49/16 451/10
8,106,651 B2 * 1/2012 Lahiri ..... H01L 22/26 324/229
9,281,253 B2 * 3/2016 Xu ..... H01L 21/67248
(Continued)

FOREIGN PATENT DOCUMENTS

JP 2005-121616 A 5/2005

OTHER PUBLICATIONS

"A Thickness Measurement System for Metal Films" Yang et al, "A Thickness Measurement System for Metal Films Based on Eddy-Current Method With Phase Detection" in IEEE Transactions on Industrial Electronics, vol. 64, No. 5, pp. 3940-3949, May 2017, doi: 10.1109/TIE.2017.2650861. (Year: 2017).*

*Primary Examiner* — Joel D Crandall
*Assistant Examiner* — Robert F Neibaur
(74) *Attorney, Agent, or Firm* — Leydig, Voit & Mayer, Ltd.

(57) ABSTRACT

An output of an eddy current sensor includes an impedance component. A film thickness measuring apparatus obtains film thickness information from the impedance component. Using a non-linear function between the film thickness information and the film thickness, the film thickness is obtained from the film thickness information. When a resistance component and a reactance component of the impedance component are associated with respective axes of a coordinate system having two orthogonal coordinate axes, the film thickness information is a reciprocal of a tangent of an impedance angle which is an angle formed by a straight line connecting a point on the coordinate system corresponding to the impedance component and a predetermined reference point, and a predetermined straight line.

4 Claims, 13 Drawing Sheets

(56) References Cited

U.S. PATENT DOCUMENTS

| | | | | |
|---|---|---|---|---|
| 2007/0103150 | A1 | 5/2007 | Tada et al. | |
| 2012/0129277 | A1 | 5/2012 | Lahiri et al. | |
| 2013/0065493 | A1* | 3/2013 | Takahashi | B24B 49/105 451/259 |
| 2015/0111468 | A1 | 4/2015 | Li et al. | |
| 2015/0224623 | A1 | 8/2015 | Xu et al. | |
| 2018/0016676 | A1* | 1/2018 | Nakamura | B24B 49/105 |

* cited by examiner

POLISHING APPARATUS AND CALIBRATION METHOD

CROSS-REFERENCE TO RELATED APPLICATION

This patent application claims the benefit of Japanese Patent Application No. 2018-133604, filed on Jul. 13, 2018, which is incorporated by reference in its entirety herein.

TECHNICAL FIELD

The present invention relates to a polishing apparatus and a calibration method.

BACKGROUND ART

As semiconductor devices become more highly integrated and implemented with higher density in recent years, the wiring of circuits has been further miniaturized and the number of layers of multilayer wiring has also been increasing. In order to realize multilayer wiring while achieving circuit miniaturization, it is necessary to planarize the surfaces of the semiconductor devices with high accuracy.

Chemical mechanical polishing (CMP) is known as a technique of planarizing the surface of a semiconductor device. A polishing apparatus for performing CMP is provided with a polishing table to which a polishing pad is attached, and a top ring for holding a polishing target (e.g., a substrate such as a semiconductor wafer or each kind of film formed on the surface of a substrate). The polishing apparatus polishes the polishing target by pressing the polishing target held by the top ring against the polishing pad while rotating the polishing table.

The polishing apparatus is provided with a monitoring apparatus that monitors a film thickness of a conductive film to detect an end point of a polishing step based on the film thickness of the polishing target. The monitoring apparatus is provided with a film thickness sensor to detect a film thickness of the polishing target. A typical example of the film thickness sensor is an eddy current sensor.

The eddy current sensor is disposed in a hole or the like formed in a polishing table, and detects the film thickness when it is located opposite to the polishing target while rotating along with the rotation of the polishing table. The eddy current sensor causes the polishing target such as a conductive film to induce eddy current therein, and detects a change of thickness of the polishing target from a change of a magnetic field generated by the eddy current induced in the polishing target.

Japanese Patent Laid-Open No. 2005-121616 discloses a technique relating to an eddy current sensor. This eddy current sensor is provided with a sensor coil disposed in the vicinity of a conductive film, a signal source that supplies an AC signal to the sensor coil to form an eddy current in the conductive film and a detection circuit that detects the eddy current formed in the conductive film as an impedance seen from the sensor coil. The eddy current sensor then displays a resistance component and a reactance component of the impedance on orthogonal coordinate axes. The film thickness of the conductive film is detected from an angle formed by a straight line connecting the coordinates of the impedance and the coordinates of a specified central point.

Regarding the method of obtaining the film thickness from the angle, a relationship between the angle and the film thickness as shown in FIG. 13 in the Publication is measured in advance, and the angle is directly converted to the film thickness using this relationship. More specifically, a central point (reference point) P according to the film quality of the conductive film, and a large number of angles of elevation θ relating to many film thicknesses of the conductive film are obtained and stored in a memory. One preliminary measurement straight line is obtained for each angle of elevation θ. A large number of preliminary measurement straight lines are obtained in accordance with a large number of angles of elevation θ. After this, during operation of a substrate polishing apparatus, the film thickness of the conductive film is calculated based on the angle of elevation θ of measurement straight line rn connecting the output values of the resistance component and the reactance component of the impedance for each measurement and the central point P in the memory, and the preliminary measurement straight lines.

According to Japanese Patent Laid-Open No. 2005-121616, the reference point P and the large number of preliminary measurement straight lines necessary to calculate the film thickness of the conductive film are obtained in advance through a large number of measurements based on the angle of elevation θ. That is, impedances are measured in advance for various film thicknesses and distances between a plurality of types of polishing targets and the eddy current sensor. This method involves a problem that many measurements need to be done in advance.

CITATION LIST

Patent Literature

PTL 1: Japanese Patent Laid-Open No. 2005-121616

An aspect of the present invention has been implemented to solve the above-described problem, and it is an object of the present invention to provide a polishing apparatus and a calibration method capable of reducing the number of measurements of a film thickness required in advance compared to the prior art.

SUMMARY

According to one embodiment 1, a polishing apparatus is provided with a rotatable polishing table that can hold a polishing pad having a polishing surface, a top ring that presses a substrate to be polished against the polishing surface and can polish a conductive film on the substrate, an eddy current sensor disposed in the polishing table and a monitoring apparatus that can monitor a film thickness of the conductive film based on an output of the eddy current sensor, wherein the output of the eddy current sensor includes an impedance component, the monitoring apparatus obtains film thickness information from the impedance component and can calculate the film thickness from the film thickness information using correspondence information indicating a non-linear relationship between the film thickness information and the film thickness, and when a resistance component and a reactance component of the impedance component are associated with the respective axes of a coordinate system having two orthogonal coordinate axes, the film thickness information is a reciprocal of a tangent of an impedance angle, which is an angle formed between a straight line connecting a point on the coordinate system corresponding to the impedance component and a predetermined reference point, and a predetermined straight line.

According to another embodiment 2, in the polishing apparatus according to embodiment 1, the correspondence information includes information indicating that the film thickness is a quadratic function of the reciprocal.

According to another embodiment 3, in the polishing apparatus according to embodiment 1, the correspondence information includes information indicating that the film thickness is an exponential function of the reciprocal.

According to another embodiment 4, the polishing apparatus according to any one of embodiment s 1 to 3, further includes a temperature sensor that can directly or indirectly measure a temperature of the substrate under polishing and a temperature correction unit that can correct the obtained film thickness using the measured temperature.

According to another embodiment 5, in a calibration method for a first eddy current sensor disposed in a polishing table to monitor a film thickness of a conductive film when a substrate to be polished is pressed against a polishing surface of a polishing pad held by the polishing table to polish the conductive film on the substrate, the calibration method includes preparing at least three substrates in which the at least three substrates are a first substrate having a first film thickness, a second substrate having a second film thickness and a third substrate having a third film thickness, and the first film thickness, the second film thickness and the third film thickness are different from one another, measuring the first, second and third substrates using the first eddy current sensor to obtain first, second and third film thickness information from an impedance component of an output of the first eddy current sensor for the first, second and third substrates respectively, and obtaining correspondence information indicating a non-linear relationship between the first, second and third film thicknesses and the corresponding first, second and third film thickness information from at least the first, second and third film thicknesses and at least the first, second and third film thickness information.

According to another embodiment 6, the calibration method according to embodiment 5, further includes disposing a second eddy current sensor in the polishing table to monitor a film thickness of the conductive film, measuring the first, second and third substrates using the second eddy current sensor and obtaining fourth, fifth and sixth film thickness information from an impedance component of an output of the second eddy current sensor for the first, second and third substrates respectively, measuring the first, second and third substrates using the first eddy current sensor at positions of the first, second and third substrates measured using the second eddy current sensor and obtaining seventh, eighth and ninth film thickness information for the first, second and third substrates respectively, calculating fourth, fifth and sixth film thicknesses from the seventh, eighth and ninth film thickness information using the correspondence information obtained for the first eddy current sensor, and obtaining correspondence information indicating a non-linear relationship between film thickness information and a film thickness of the second eddy current sensor indicating a relationship between the fourth, fifth and sixth film thicknesses and the corresponding fourth, fifth and sixth film thickness information from at least the fourth, fifth and sixth film thicknesses and at least the fourth, fifth and sixth film thickness information.

According to another embodiment 7, in a calibration method for a first eddy current sensor disposed on a polishing table to monitor a film thickness of a conductive film when a substrate to be polished is pressed against a polishing surface of a polishing pad held by the polishing table to polish the conductive film on the substrate, the calibration method includes preparing at least one first substrate having a first film thickness and at least one second substrate having a second film thickness, the first film thickness being different from the second film thickness, measuring the first and second substrates using the first eddy current sensor and obtaining first and second film thickness information from an impedance component of an output of the first eddy current sensor for the first and second substrates respectively, polishing the second substrate, obtaining the second substrate having a third film thickness, then measuring the second substrate using the first eddy current sensor and obtaining third film thickness information from an impedance component of the output of the first eddy current sensor, measuring a film thickness of the second substrate after polishing using a film thickness measuring machine and obtaining the third film thickness, and obtaining correspondence information indicating a non-linear relationship between the first, second and third film thicknesses and the corresponding first, second and third film thickness information from at least the first, second and third film thicknesses and at least the first, second and third film thickness information.

According to another embodiment 8, the calibration method according to embodiment 7, further includes disposing a second eddy current sensor in the polishing table to monitor the film thickness of the conductive film, measuring the first and second substrates using the second eddy current sensor and obtaining fourth and fifth film thickness information from an impedance component of an output of the second eddy current sensor for the first substrate and the second substrate before polishing respectively, measuring the second substrate using the second eddy current sensor and obtaining sixth film thickness information from an impedance component of the output of the second eddy current sensor for the second substrate after polishing, measuring the first and second substrates using the first eddy current sensor at positions of the first and second substrates at which the second eddy current sensor measures the first and second substrates and obtaining seventh, eighth and ninth film thickness information for the first substrate and the second substrate having the second and third film thicknesses respectively, calculating fourth, fifth and sixth film thicknesses from the seventh, eighth and ninth film thickness information using the correspondence information obtained for the first eddy current sensor, and obtaining correspondence information indicating a non-linear relationship between film thickness information and a film thickness of the second eddy current sensor indicating a relationship between the fourth, fifth and sixth film thicknesses and the corresponding fourth, fifth and sixth film thickness information from at least the fourth, fifth and sixth film thicknesses and at least the fourth, fifth and sixth film thickness information.

According to another embodiment 9, in a calibration method for a first eddy current sensor disposed in a polishing table to monitor a film thickness of a conductive film when a substrate to be polished is pressed against a polishing surface of a polishing pad held by the polishing table to polish the conductive film on the substrate, the calibration method includes preparing at least one substrate having a first film thickness, measuring the substrate using the first eddy current sensor and obtaining first film thickness information from an impedance component of an output of the first eddy current sensor for the substrate, polishing the substrate, obtaining the substrate having a second film thickness, then measuring the substrate using the first eddy current sensor and obtaining second film thickness information from an impedance component of the output of the first eddy current sensor, measuring a film thickness of the substrate having the second film thickness using a film thickness measuring machine and obtaining the second film thickness, polishing the substrate having the second film thickness, obtaining the substrate having a third film thickness, then measuring the substrate using the first eddy current sensor and obtaining third film thickness information from an impedance component of the output of the first eddy current sensor, measuring a film thickness of the substrate having the third film thickness using the film thickness measuring machine and obtaining the third film thickness, and obtaining correspondence information indicating a non-linear relationship between the first, second and third film thicknesses and the corresponding first, second and third film thickness information from at least the first, second and third film thicknesses and at least the first, second and third film thickness information.

According to another embodiment 10, the calibration method according to embodiment 9, further includes disposing a second eddy current sensor in the polishing table to monitor a film thickness of the conductive film, measuring the substrate using the second eddy current sensor and obtaining fourth film thickness information from an impedance component of the output of the second eddy current sensor for the substrate having the first film thickness, measuring the substrate using the second eddy current sensor and obtaining fifth film thickness information from an impedance component of the output of the second eddy current sensor for the substrate having the second film thickness, measuring the substrate using the second eddy current sensor and obtaining sixth film thickness information from an impedance component of the output of the second eddy current sensor for the substrate having the third film thickness, measuring the substrate using the first eddy current sensor at positions of the substrate at which the second eddy current sensor measures the substrate and obtaining seventh, eighth and ninth film thickness information for the substrates having the first, second and third film thicknesses respectively, calculating fourth, fifth and sixth film thicknesses from the seventh, eighth and ninth film thickness information using the correspondence information obtained for the first eddy current sensor, and obtaining correspondence information indicating a non-linear relationship between film thickness information and a film thickness of the second eddy current sensor indicating a relationship between the fourth, fifth and sixth film thicknesses and the corresponding fourth, fifth and sixth film thickness information from at least the fourth, fifth and sixth film thicknesses and at least the fourth, fifth and sixth film thickness information.

According to another embodiment 11, in the calibration method according to any one of embodiment s 5 to 10, the first film thickness is substantially 0 mm.

DESCRIPTION OF EMBODIMENTS

Figure 1:
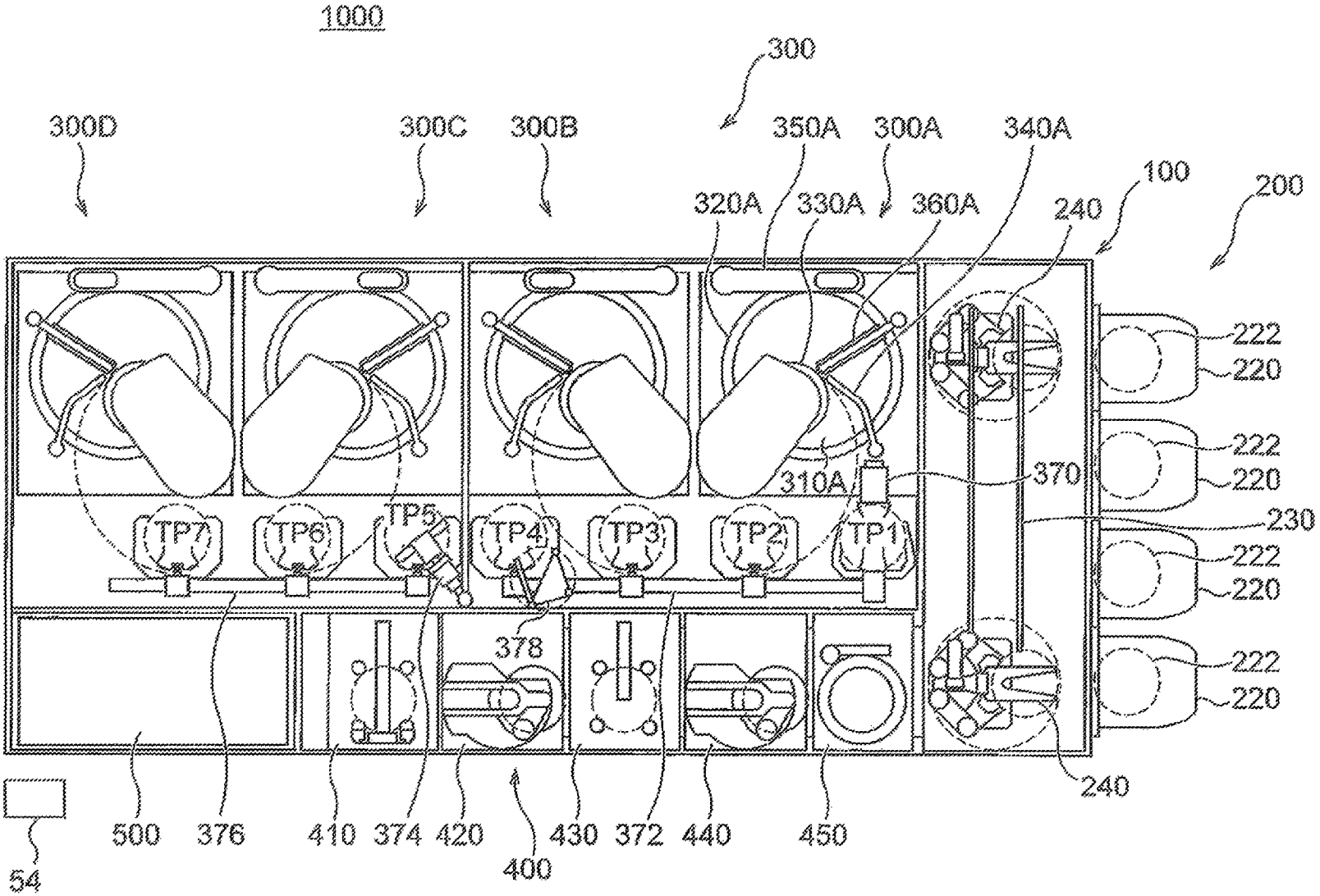
FIG. 1 is a plan view illustrating an overall configuration of a substrate processing apparatus according to an embodiment of the present invention.

Hereinafter, embodiments of the present invention will be described with reference to the accompanying drawings. Note that in the following embodiments, identical or corresponding members are assigned the same reference numerals and overlapping description thereof may be omitted. Furthermore, features described in each embodiment are applicable to other embodiments as long as the features do not contradict each other.

<Substrate Processing Apparatus>

FIG. 1 is a plan view of a substrate processing apparatus. As shown in FIG. 1, the substrate processing apparatus 1000 is provided with a loading/unloading unit 200, a polishing unit 300 and a cleaning unit 400. The substrate processing apparatus 1000 is further provided with a control unit 500 for controlling various operations of the loading/unloading unit 200, the polishing unit 300 and the cleaning unit 400. Hereinafter, the loading/unloading unit 200, the polishing unit 300 and the cleaning unit 400 will be described.

<Loading/Unloading Unit>

The loading/unloading unit 200 is a unit for passing a substrate before being subjected to processing such as polishing and cleaning to the polishing unit 300 and receiving the substrate after being subjected to processing such as polishing and cleaning from the cleaning unit 400. The loading/unloading unit 200 is provided with a plurality of (four units in the present embodiment) front loading units 220. The front loading units 220 are each mounted with a cassette 222 to stock substrates.

The loading/unloading unit 200 is provided with a rail 230 disposed inside a housing 100 and a plurality of (two in the present embodiment) transport robots 240 disposed on the rail 230. The transport robot 240 extracts a substrate before being subjected to processing such as polishing and cleaning from the cassette 222 and passes it to the polishing unit 300. Furthermore, the transport robot 240 receives a substrate after being subjected to processing such as polishing and cleaning from the cleaning unit 400 and returns it to the cassette 222.

<Polishing Unit>

The polishing unit 300 is a unit for polishing a substrate. The polishing unit 300 is provided with a first polishing unit 300A, a second polishing unit 300B, a third polishing unit 300C and a fourth polishing unit 300D. The first polishing unit 300A, the second polishing unit 300B, the third polishing unit 300C and the fourth polishing unit 300D have the same configuration. Therefore, only the first polishing unit 300A will be described hereinafter.

The first polishing unit 300A (polishing apparatus) is provided with a polishing table 320A and a top ring 330A. The polishing table 320A is driven to rotate by a drive source which is not shown. A polishing pad 310A is pasted to the polishing table 320A. The top ring 330A holds a substrate and presses the substrate against the polishing pad 310A. The top ring 330A is driven to rotate by a drive source which is not shown. The substrate is held to the top ring 330A, pressed against the polishing pad 310A and is thereby polished.

Next, a transport mechanism for transporting the substrate will be described. The transport mechanism is provided with a lifter 370, a first linear transporter 372, a swing transporter 374, a second linear transporter 376 and a temporary stand 378.

The lifter 370 receives a substrate from the transport robot 240. The first linear transporter 372 transports the substrate received from the lifter 370 between a first transfer position TP1, a second transfer position TP2, a third transfer position TP3 and a fourth transfer position TP4. The first polishing unit 300A and the second polishing unit 300B receive the substrate from the first linear transporter 372 and polish it. The first polishing unit 300A and the second polishing unit 300B pass the polished substrate to the first linear transporter 372.

The swing transporter 374 transports the substrate between the first linear transporter 372 and the second linear transporter 376. The second linear transporter 376 transports the substrate received from the swing transporter 374 among a fifth transfer position TP5, a sixth transfer position TP6 and a seventh transfer position TP7. The third polishing unit 300C and the fourth polishing unit 300D receive the substrate from the second linear transporter 376 and polish it. The third polishing unit 300C and the fourth polishing unit 300D pass the polished substrate to the second linear transporter 376. The substrate polished by the polishing unit 300 is placed on the temporary stand 378 by the swing transporter 374.

<Cleaning Unit>

The cleaning unit 400 is a unit for cleaning and drying the substrate polished by the polishing unit 300. The cleaning unit 400 is provided with a first cleaning chamber 410, a first transport chamber 420, a second cleaning chamber 430, a second transport chamber 440 and a drying chamber 450.

The substrate placed on the temporary stand 378 is transported to the first cleaning chamber 410 or the second cleaning chamber 430 via the first transport chamber 420. The substrate is cleaned in the first cleaning chamber 410 or the second cleaning chamber 430. The substrate cleaned in the first cleaning chamber 410 or the second cleaning chamber 430 is transported to the drying chamber 450 via the second transport chamber 440. The substrate is dried in the drying chamber 450. The dried substrate is extracted from the drying chamber 450 and returned to the cassette 222 by the transport robot 240.

<Detailed Configuration of First Polishing Unit>

Figure 2:
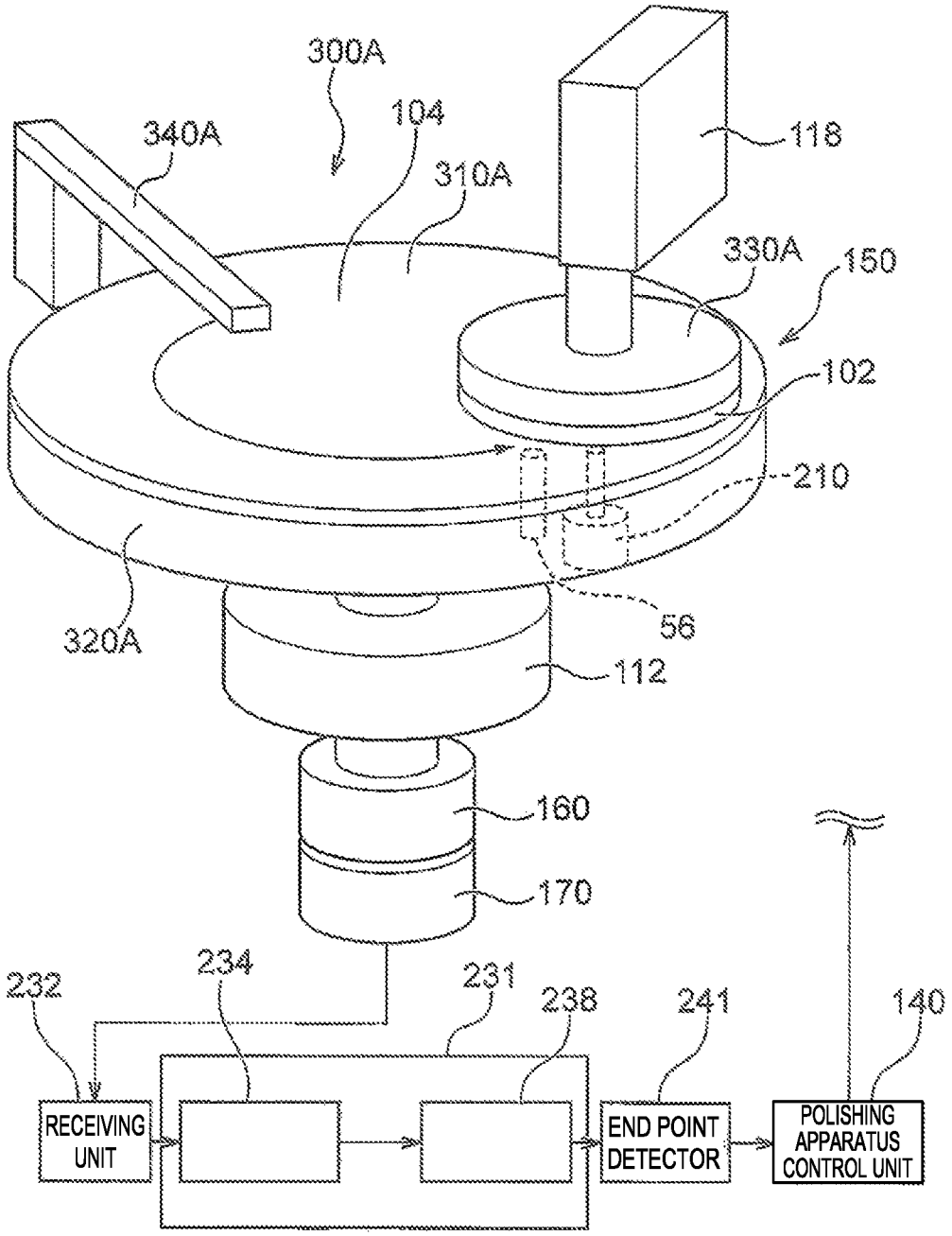
FIG. 2 is a diagram schematically illustrating an overall configuration of a polishing apparatus.
Figure 3A:
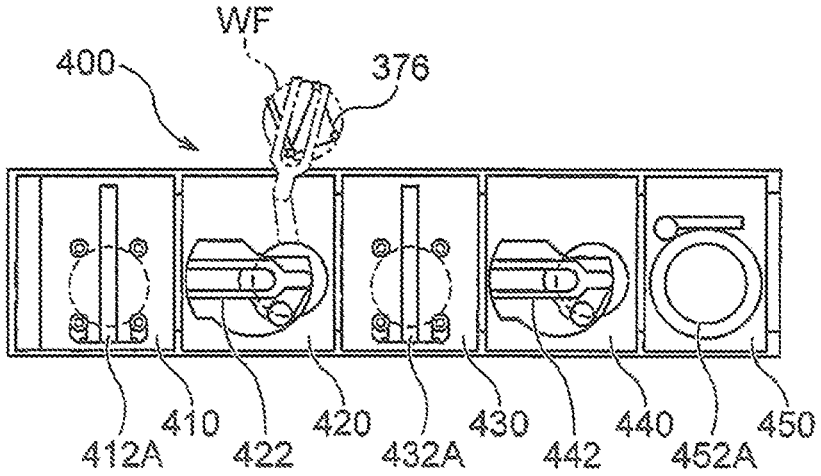
FIG. 3A is a plan view of a cleaning unit.
Figure 3B:
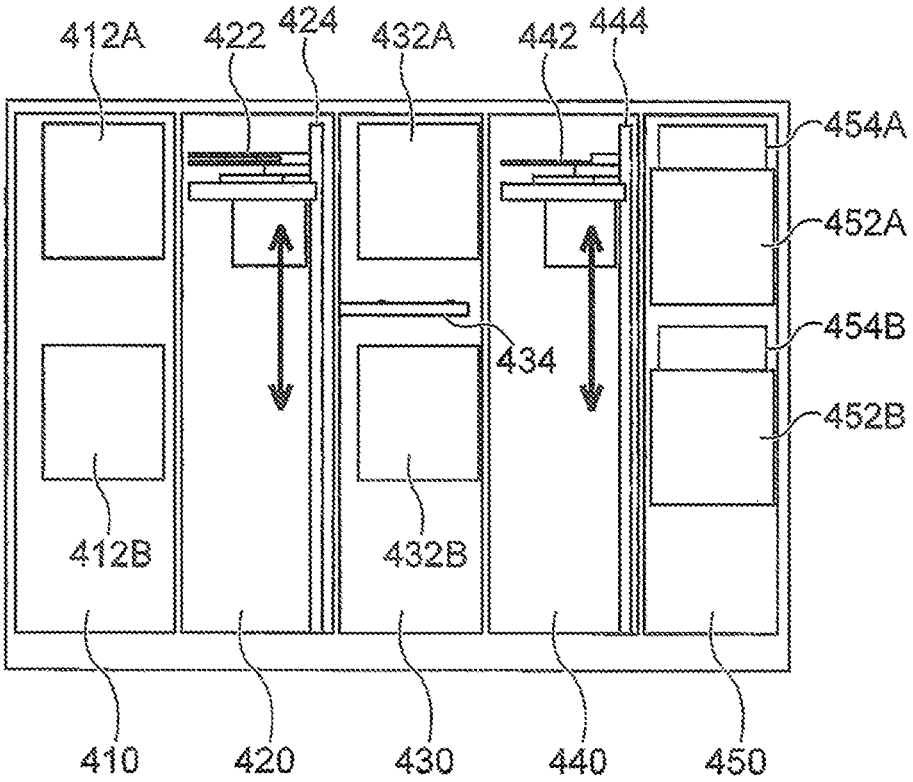
FIG. 3B is a side view of the cleaning unit.

Next, details of the first polishing unit 300A will be described. FIG. 2 is a perspective view of the first polishing unit 300A. The first polishing unit 300A is provided with a polishing liquid supply nozzle 340A for supplying a polishing liquid or a dressing liquid to the polishing pad 310A. The polishing liquid is, for example, slurry. The dressing liquid is, for example, pure water. The first polishing unit 300A is provided with a dresser 350A for performing conditioning of the polishing pad 310A. The first polishing unit 300A is also provided with an atomizer 360A for jetting a liquid or a mixed fluid of liquid and gas toward the polishing pad 310A. The liquid is, for example, pure water. The gas is, for example, a nitrogen gas.

The first polishing unit 300A includes a polishing unit 150 for polishing a polishing target (e.g., substrate such as a semiconductor wafer or various films formed on the surface of the substrate) 102. The polishing unit 150 is provided with the polishing table 320A, on a top surface of which the polishing pad 310A for polishing the polishing target 102 can be mounted, a first electric motor 112 for driving the polishing table 320A to rotate, the top ring 330A that can hold the polishing target 102 and a second electric motor 118 that can drive the top ring 330A to rotate.

The polishing unit 150 is provided with the polishing liquid supply nozzle 340A that supplies a polishing abrasive liquid containing a polishing material to the top surface of the polishing pad 310A. The first polishing unit 300A is provided with a polishing apparatus control unit 140 that outputs various control signals associated with the polishing unit 150.

The first polishing unit 300A is provided with an eddy current sensor 210 disposed in a hole formed in the polishing table 320A to detect a film thickness of the polishing target 102 along a polishing surface 104 as the polishing table 320A rotates.

When polishing the polishing target 102, the first polishing unit 300A supplies polishing slurry containing polishing abrasive grain from the polishing liquid supply nozzle 340A to the top surface of the polishing pad 310A and causes the first electric motor 112 to drive the polishing table 320A to rotate. The first polishing unit 300A causes the top ring 330A to rotate around an axis of rotation decentered from the rotation shaft of the polishing table 320A and presses the polishing target 102 held to the top ring 330A against the polishing pad 310A. Thus, the polishing target 102 is polished and planarized by the polishing pad 310A holding the polishing slurry.

A receiving unit 232 is connected to the eddy current sensor 210 via rotary joint connectors 160 and 170. The receiving unit 232 receives a signal outputted from the eddy current sensor 210 and outputs the signal as impedance. A temperature sensor 56, which will be described later, is connected to the polishing apparatus control unit 140 via the rotary joint connectors 160 and 170.

As shown in FIG. 2, a film thickness measuring apparatus 231 performs predetermined signal processing on the impedance outputted from the receiving unit 232 and outputs the impedance to an end point detector 241.

The end point detector 241 monitors a change in the film thickness of the polishing target 102 based on the signal outputted from the film thickness measuring apparatus 231. The film thickness measuring apparatus 231 and the end point detector 241 constitute a monitoring apparatus. The end point detector 241 is connected to the polishing apparatus control unit 140 that performs various kinds of control relating to the first polishing unit 300A. Upon detecting a polishing end point of the polishing target 102, the end point detector 241 outputs a signal indicating the polishing end point to the polishing apparatus control unit 140. Upon receiving the signal indicating the polishing end point from the end point detector 241, the polishing apparatus control unit 140 causes the polishing by the first polishing unit 300A to end. During polishing, the polishing apparatus control unit 140 controls the pressing pressure to the polishing target 102 based on the film thickness.

In the present embodiment, the output of the eddy current sensor 210 includes an impedance component. The monitoring apparatus obtains film thickness information from the impedance component and obtains the film thickness from the film thickness information using correspondence information indicating a non-linear relationship between the film thickness information and the film thickness. When the resistance component and the reactance component of the impedance component are respectively associated with two axes of an orthogonal coordinate system, the film thickness information is a reciprocal of the tangent of an impedance angle which is an angle $\alpha$ formed by a straight line connecting a point on the coordinate system corresponding to the impedance component and a predetermined reference point with respect to a predetermined straight line.

Here, the "impedance component" means the resistance component and/or the reactance component of an impedance. The present embodiment calculates the film thickness from the film thickness information using correspondence information indicating a non-linear relationship between the film thickness information and the film thickness, and can thereby reduce the number of measurements of the film thickness required in advance compared to the prior art. According to Japanese Patent Laid-Open No. 2005-121616, preliminary measurements (that is, calibrations) are necessary for many angles of elevation $\theta$ to calculate the film thickness of the conductive film based on the angle of elevation $\theta$. On the other hand, the present embodiment uses the non-linear relationship (e.g., non-linear functions such as quadratic function), and so if calibration is performed on at least three different film thicknesses, it is possible to determine the non-linear functions, and it is easier to perform calibration than in the prior art.

The correspondence information indicating the non-linear relationship between the film thickness information and the film thickness means correspondence information in which the relationship between the film thickness and the film thickness information is expressed by a function other than a linear function or correspondence information (a table or the like expressing the relationship between the film thickness information and the film thickness) corresponding to a function other than a linear function. An example of the correspondence information indicating the non-linear relationship is a non-linear function.

Note that the present embodiment uses a non-linear relationship (e.g., non-linear function such as a quadratic function), and so it is possible to calculate the film thickness of a thin film having a relatively small resistivity such as a copper thin film with higher accuracy than when using a linear function. This point will be described later. The reciprocal of the tangent of the impedance angle also includes one equivalent to the reciprocal of the tangent of the impedance angle. For example, when the impedance angle is assumed to be a, the reciprocal of the tangent of the impedance angle is $1/\tan\alpha$ and the following amount is also equivalent to $1/\tan\alpha$.

$$\cot\alpha=\cos\alpha/\sin\alpha \text{(cotangent function)}$$

Furthermore, when the impedance angle $\alpha$ can be expressed by another amount, for example, when $\alpha=f(\beta)$, $1/\tan(f(\beta))$ is equivalent to the reciprocal $1/\tan\alpha$ of the tangent of the impedance angle. Here $f(\beta)$ is a function of $\beta$. The function of $\beta$ may have a table format or the like. Note that instead of obtaining the angle $\alpha$, the tangent of the angle $\alpha$ or the reciprocal of the tangent may be directly obtained.

Here, an overview of calibration for obtaining correspondence information in the present embodiment will be described. When a film thickness is measured using the eddy current sensor 210, it is necessary to obtain a correspondence relationship between data obtained from the output of the eddy current sensor 210 and the film thickness in advance. In the present embodiment, the angle $\alpha$ is obtained from the output of the eddy current sensor 210. The definition of the angle $\alpha$ and details of the method of obtaining it will be described later.

As will be described later, $1/\tan\alpha$ calculated from the angle $\alpha$ is proportional to the film thickness t when the film thickness is large. That is, when $1/\tan\alpha=Ta$ is assumed, there is a relationship: film thickness $t=A_th\times Ta$. Here, A_th is a proportion coefficient. In actual measurement of a film thickness, Ta can be obtained from a measured value of the eddy current sensor 210.

Therefore, when the film thickness is large, the proportion coefficient A_th in the correspondence relationship between the output of "film thickness $t=A_th\times Ta$" and the film thickness of the eddy current sensor 210 may be obtained at the time of calibration. Once the proportion coefficient A_th is obtained, the film thickness can be calculated if the angle $\alpha$ is obtained from the output of the eddy current sensor 210 in the measurement after the calibration. When the film thickness is small, the correspondence relationship between the output of the eddy current sensor 210 and the film thickness is a non-linear relationship. Note that the output of the eddy current sensor 210 obtained from the output of the eddy current sensor 210 may include an impedance (X, Y) which will be described later or the above-described angle $\alpha$, $\tan\alpha$, $1/\tan\alpha$, Ta or the like.

Figure 4:
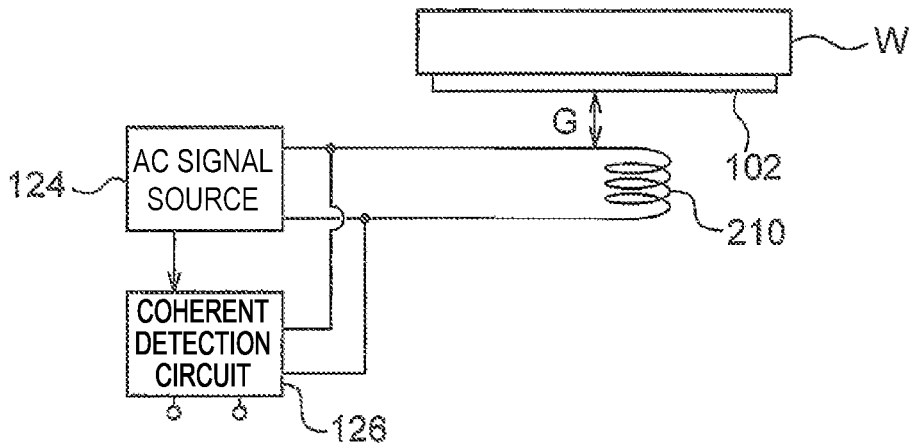
FIG. 4 is a block diagram illustrating a configuration example of an eddy current sensor that can measure impedance.

FIG. 4 illustrates the eddy current sensor 210 provided for the first polishing unit 300A. An impedance seen from the sensor coil toward the conductive film side changes and the eddy current sensor detects the film thickness from this impedance change. The eddy current sensor 210 disposes the sensor coil in the vicinity of the polishing target 102 to be detected and an AC signal source 124 is connected to the coil. The polishing target 102 to be detected is, for example, a copper plating film having a thickness on the order of 0 to 2 μm formed on a semiconductor wafer W (may also be a vapor deposition film of metallic material such as Au, Cr, W). The sensor coil is disposed in the vicinity, for example, on the order of 0.5 to 5 mm, of the conductive film to be detected. A coherent detection circuit 126 detects an impedance Z (components of which are X and Y) seen from the sensor coil side including the polishing target 102 to be detected (details will be described later).

Figure 5:
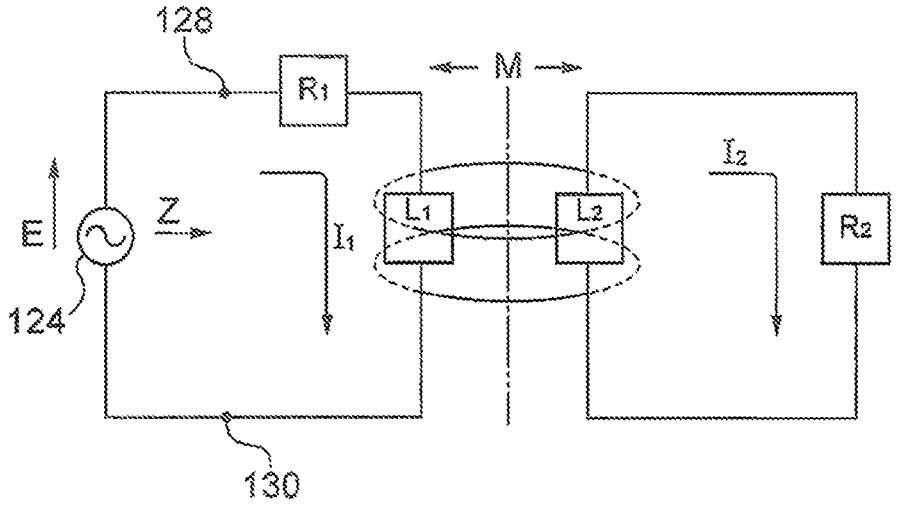
FIG. 5 is an equivalent circuit diagram of the block diagram in FIG. 4.

In an equivalent circuit shown in FIG. 5, an oscillating frequency of the AC signal source 124 is constant, and if the film thickness of the polishing target 102 changes, the impedance Z seen from the AC signal source 124 toward the sensor coil side changes. That is, in the equivalent circuit shown in FIG. 5, an eddy current $I_2$ flowing into the polishing target 102 is determined by an equivalent resistance $R_2$ and a self-inductance $L_2$ of the polishing target 102. When the film thickness changes, the eddy current $I_2$ changes, which is considered as a change in the impedance Z seen from the AC signal source 124 side via a mutual inductance M with the sensor coil side. Here, $L_1$ is a self-inductance portion of the sensor coil and $R_1$ is a resistance portion of the sensor coil.

Hereinafter, the eddy current sensor will be described more specifically. The AC signal source 124 is an oscillator having a fixed frequency on the order of 1 to 50 MHz, and, for example, a crystal oscillator is used. An AC voltage supplied by the AC signal source 124 causes the current $I_1$ to flow through the sensor coil. A current flows through the coil disposed in the vicinity of the polishing target 102 and this magnetic flux interlinks with the polishing target 102, a mutual inductance M is thereby formed and the eddy current $I_2$ flows through the polishing target 102. Here, $R_1$ is an equivalent resistance on the primary side including the sensor coil and $L_1$ is a self-inductance on the primary side including the sensor coil likewise. On the polishing target 102 side, $R_2$ is an equivalent resistance corresponding to an eddy current loss and $L_2$ is a self-inductance thereof. The impedance Z seen from terminals 128 and 130 of the AC signal source 124 toward the sensor coil side changes according to the magnitude of the eddy current loss formed in the polishing target 102.

Figure 6:
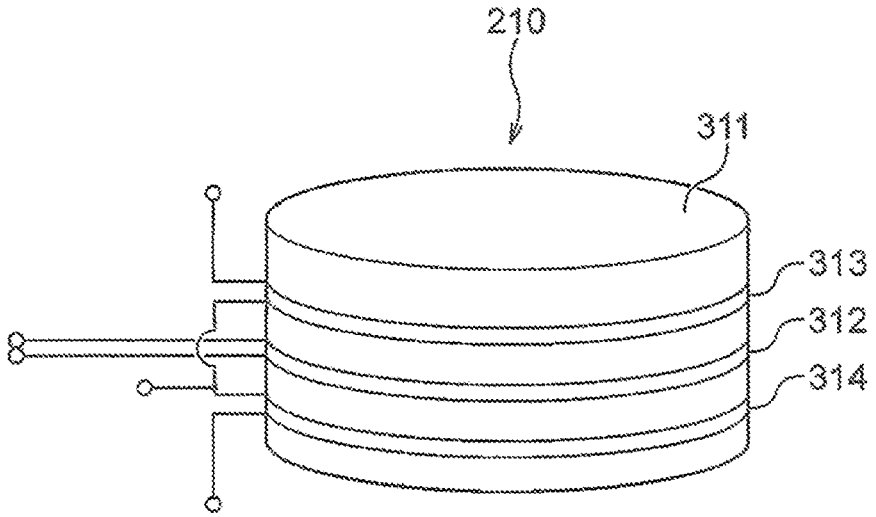
FIG. 6 is a perspective view illustrating a configuration example of a sensor coil of the eddy current sensor.

FIG. 6 illustrates a configuration example of the sensor coil in the eddy current sensor of the present embodiment. The sensor coil is formed by separating a coil for forming an eddy current in the conductive film from a coil for detecting the eddy current in the conductive film, and is constructed of three-layer coils wound around a bobbin 311. Here, an excitation coil 312 at the center is an excitation coil connected to the AC signal source 124. This excitation coil 312 forms an eddy current in the polishing target 102 on the semiconductor wafer W disposed in the vicinity through a magnetic field formed by the voltage supplied from the AC signal source 124. A detection coil 313 is disposed on the top side (conductive film side) of the bobbin 311 to detect a magnetic field generated by the eddy current formed in the conductive film. A balance coil 314 is disposed on the side opposite to the detection coil 313 of the excitation coil 312.

Figure 7:
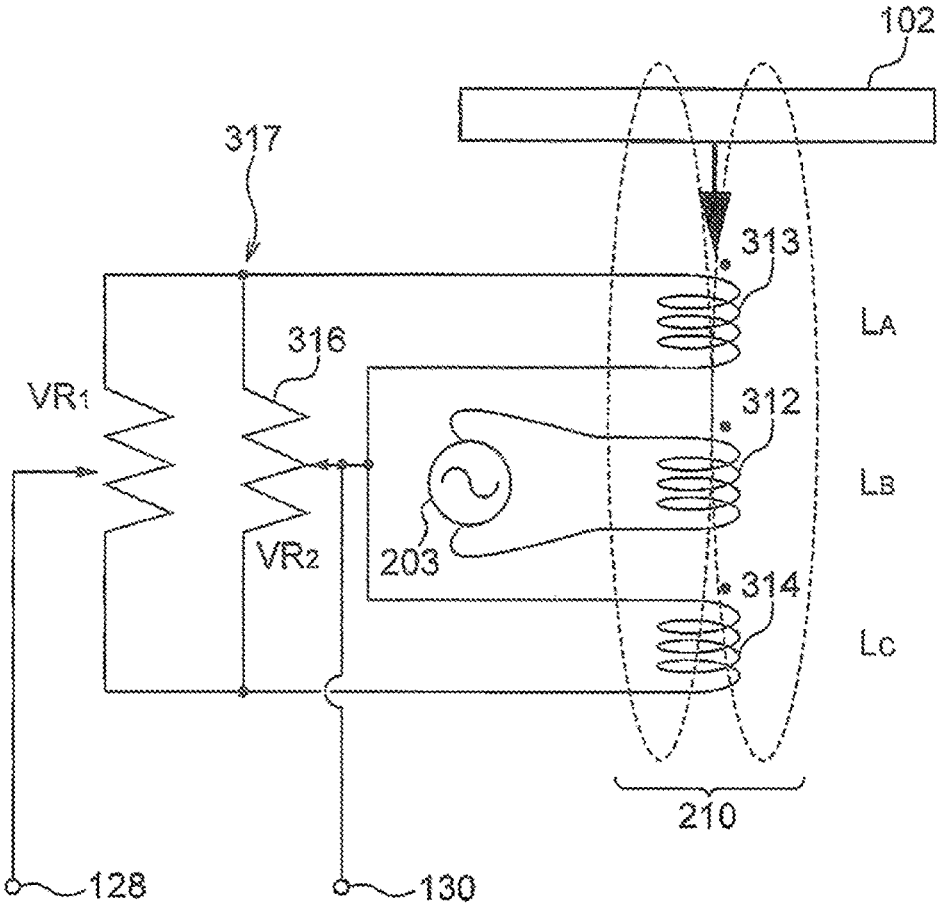
FIG. 7 is a circuit diagram illustrating a connection example of the sensor coil in FIG. 6.

FIG. 7 illustrates a connection example of each coil. The detection coil 313 and the balance coil 314 constitute a series circuit of opposite phases as described above, both ends of which are connected to a resistance bridge circuit 317 including a variable resistor 316. The coil 312 is connected to an AC signal source 203, generates an alternating magnetic flux and thereby forms an eddy current in the polishing target 102 which is the conductive film disposed in the vicinity thereof. By adjusting resistance values of variable resistors $VR_1$ and $VR_2$, the output voltage of the series circuit composed of the coils 313 and 314 can be adjusted to zero when no conductive film exists.

Figure 8:
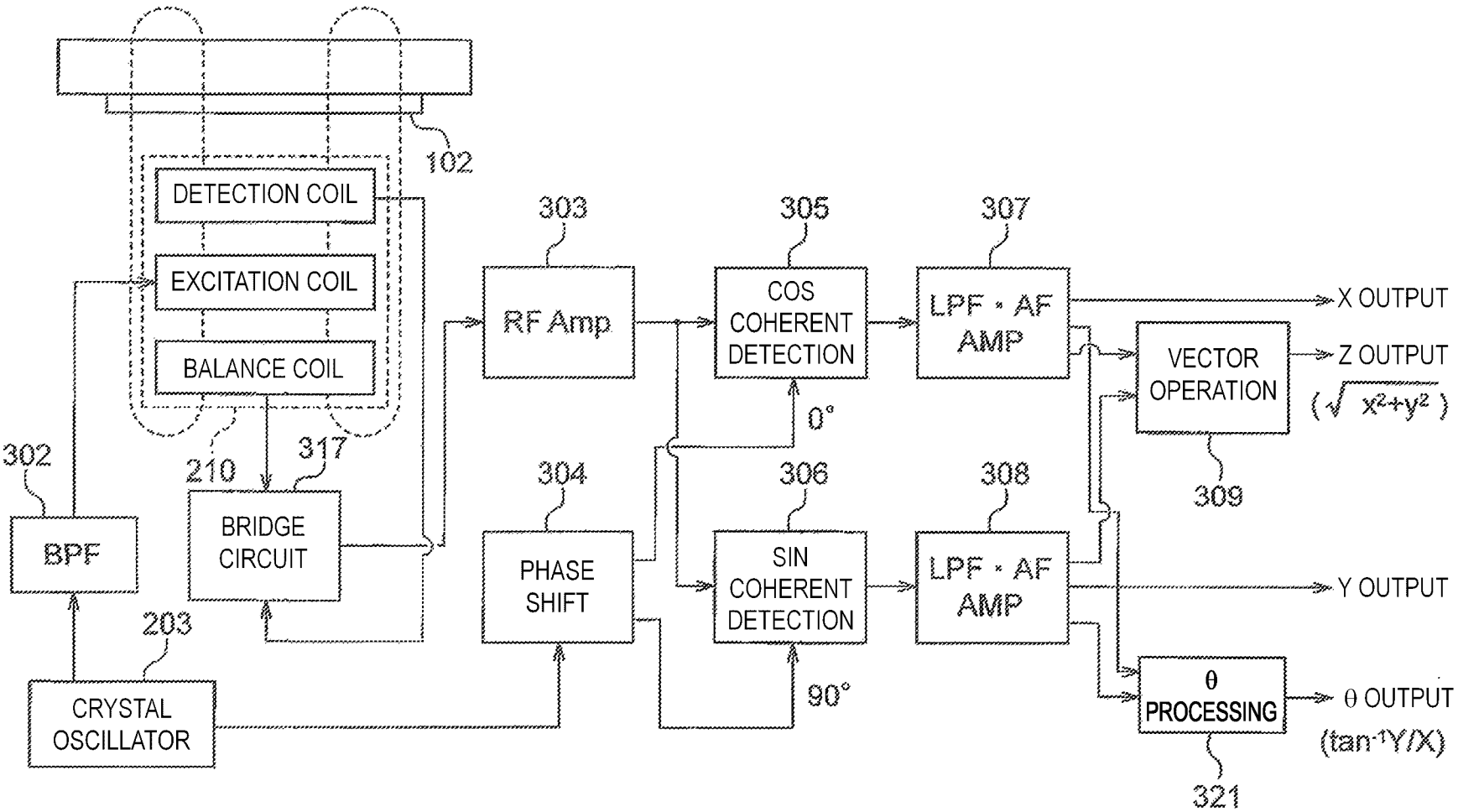
FIG. 8 is a block diagram illustrating a coherent detection circuit of a sensor coil output.

FIG. 8 shows an example of a measuring circuit of the impedance Z seen from the AC signal source 203 side toward a sensor coil 202 side. The measuring circuit of the impedance Z shown in FIG. 8 can extract impedance plane coordinate values (X, Y), (that is, reactance component (X), resistance component (Y)), impedance (Z=X+iY) and phase output ($\theta=\tan^{-1}R/X$) accompanying a change in the film thickness. Therefore, using these signal outputs allows more multifaceted detection of a progress situation of processing such as measuring the film thickness from, for example, the magnitudes of various components of impedance.

As described above, the signal source 203 that supplies an AC signal to the sensor coil disposed in the vicinity of the semiconductor wafer W on which the polishing target 102 to be detected is formed as a film is an oscillator with a fixed frequency made up of a crystal oscillator. The AC signal source 203 supplies a voltage with a fixed frequency of, for example, 1 to 50 MHz. The AC voltage formed in the signal source 203 is supplied to the excitation coil 312 via a bandpass filter 302. Signals detected at the terminals 128 and 130 of the sensor coil are inputted to the coherent detection unit made up of a cos coherent detection circuit 305 and a sin coherent detection circuit 306 via a high frequency amplifier 303 and a phase shift circuit 304. The coherent detection unit extracts a cos component (x component) and a sin component (Y component) of the detection signal. Here, the phase shift circuit 304 forms two signals of an in-phase component (0°) and a quadrature component (90°) of the signal source 203 from the oscillating signal formed in the signal source 203. These signals are respectively introduced to the cos coherent detection circuit 305 and the sin coherent detection circuit 306, where the above-described coherent detection is performed.

Low-pass filters 307 and 308 remove unnecessary high frequency components of that of higher than the signal component, for example, 5 KHz or higher, from the signals subjected to coherent detection. The coherent-detected signals are an X component output which is a cos coherent detection output and a Y component output which is a sin coherent detection output. Also, a vector operation circuit 309 obtains the magnitude of the impedance Z, $(X^2+Y^2)^{1/2}$ from the X component output and the Y component output. The vector operation circuit (θ processing circuit) 310 can obtain phase output ($\theta=\tan^{-1}Y/X$) from the X component output and the Y component output as well. Here, these filters are provided to remove a noise component of the sensor signal and cutoff frequencies corresponding to the various filters are set.

Figure 9:
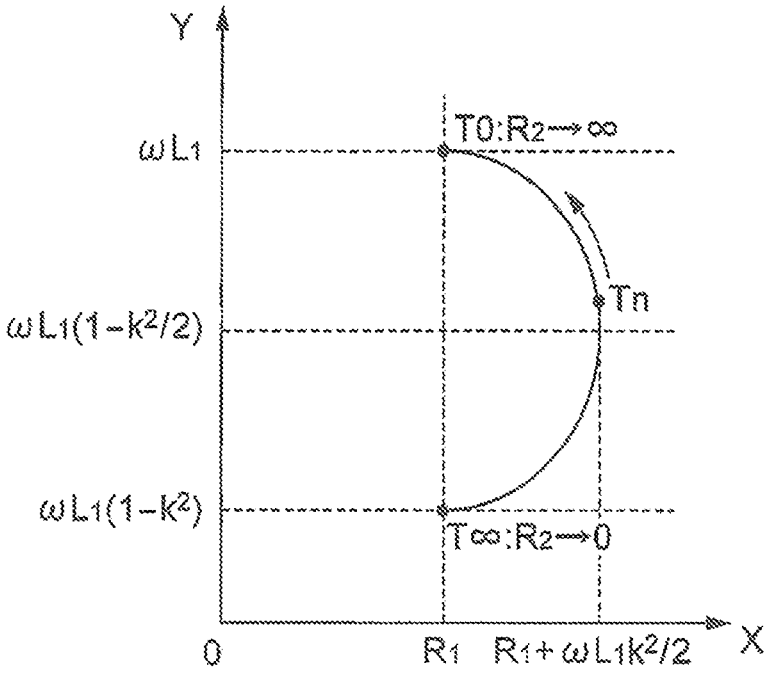
FIG. 9 is a graph illustrating a circular track of a resistance component (X) and a reactance component (Y) on an impedance coordinate plane accompanying a thickness change of a conductive film.

With reference to FIG. 9, the following will give the description that the points (coordinate values (X, Y)) on the impedance plane coordinate system that corresponds to the impedance obtained when the distance between the polishing target 102 and the eddy current sensor 210 differs will form different circles. The respective centers of the different circles are on the same straight line (second straight line). There is a common one point for the different circles. This is called a first point. These will be described.

The sensor-side circuit and the conductive-film-side circuit shown in FIG. 5 respectively hold the following equations.

$$R_1I_1+L_1dI_1/dt+MdI_2/dt=E \quad (1)$$

$$R_2I_2+L_2dI_2/dt+MdI_1/dt=0 \quad (2)$$

where, M is mutual inductance, $R_1$ is an equivalent resistance of the sensor-side circuit and $L_1$ is a self-inductance of the sensor-side circuit. $R_2$ is an equivalent resistance of the conductive film from which an eddy current is induced and $L_2$ is a self-inductance of the conductive film into which the eddy current flows.

Here, when $I_n=A_ne^{j\omega t}$ (sine wave) is assumed, the above-described equations (1) and (2) are expressed as follows.

$$(R_1+\omega L_1)I_1+j\omega MI_2=E \quad (3)$$

$$(R_2+j\omega_2)I_2+j\omega MI_1=0 \quad (4)$$

The following equation (5) is derived from these equations (3) and (4).

$$I_1=E(R_2+j\omega L_2)/\{(R_1+j\omega L_1)(R_2+j\omega L_2)+\omega^2M^2\}=E/\{(R_1+j\omega L_1)+\omega^2M^2/(R_2+j\omega L_2)\} \quad (5)$$

Therefore, the impedance Z of the sensor-side circuit is expressed by the following equation (6).

$$Z=E/I_1=\{R_1+\omega^2M^2R_2/(R_2^2+\omega^2L_2^2)\}+j\omega\{L_1-\omega^2L_2M^2/(R_2^2+\omega^2L_2^2)\} \quad (6)$$

Here, if the real part (resistance component of the impedance component) and the imaginary part (inductive reactance component of the impedance component) of Z are assumed to be X and Y respectively, the above-described equation (6) becomes as follows.

$$Z=X+j\omega Y \quad (7)$$

Here, if $Rx=\omega^2L_2M^2/(R_2^2+\omega^2L_2^2)$ is assumed, equation (7) is $$X+j\omega Y=[R_1+R_2Rx]+J\omega[L_1-L_2Rx]$$

Therefore, $X=R_1+R_2Rx$ $Y=\omega[L_1-L_2Rx]$

If these are solved with respect to $R_2$ and $L_2$, $$R_2=\omega^2(X-R_1)M^2/((\omega L_1-Y)^2+(X-R_1)^2) \quad (8)$$

$$L_2=\omega(\omega L_1-Y)M^2/((\omega L_1-Y)^2+(X-R_1)^2) \quad (9)$$

Symbol "k" shown in FIG. 9 is a coupling coefficient and the following relational expression (10) holds.

$$M=k(L_1L_2)^{1/2} \quad (10)$$

When this is applied to equation (9), $$(X-R_1)^2+(Y-\omega(1-(k^2/2))L_1)^2=(\omega L_1k^2/2)^2 \quad (11)$$

This is an equation of a circle and shows that X and Y form a circle, that is, the impedance Z forms a circle.

The eddy current sensor 210 outputs the resistance component X and the inductive reactance component Y of the impedance of the electric circuit including the coil of the eddy current sensor 210. These resistance component X and inductive reactance component Y are film thickness signals reflecting the film thickness and change in accordance with the thickness of the conductive film on the substrate.

FIG. 9 is a graph drawn by plotting X and Y that change along with the thickness of the conductive film on the XY coordinate system. The coordinates of a point T∞ are X and Y when the film thickness is infinite, that is, when $R_2$ is 0. The coordinates of the point T0 (first point: predetermined reference point) are X and Y when the film thickness is 0, that is, when $R_2$ is infinite, if conductivity of the substrate is negligible. The point Tn (second point) positioned from the values of X and Y advances toward the point T0 while describing an arc-like track as the thickness of the conductive film decreases.

Figure 10:
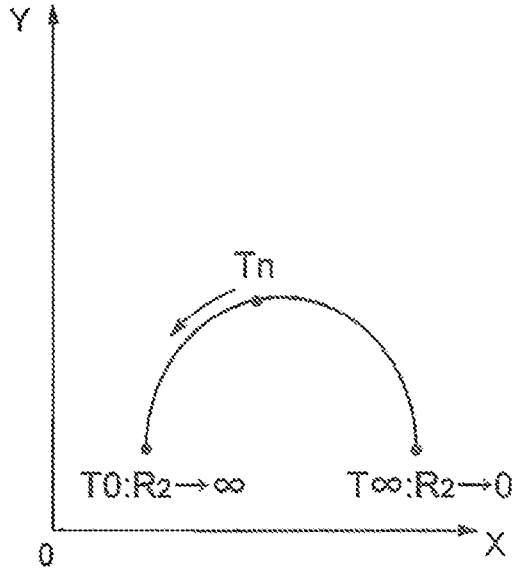
FIG. 10 is a graph resulting from rotating the graphic diagram in FIG. 9 counterclockwise by 90 degrees and further translating the graphic diagram.

FIG. 10 is a graph resulting from rotating the graphic diagram in FIG. 9 counterclockwise by 90 degrees and further translating the graphic diagram. As shown in FIG. 10, as the film thickness decreases, the point Tn positioned from the values of X and Y advances toward the point T0 while describing an arc-like track. The coupling coefficient k is a ratio at which the magnetic field generated by one coil transmits to the other coil. k=1 is maximum and when the distance between the coils is separated, that is, if the polishing pad 310A becomes thicker, k becomes smaller.

Figure 11:
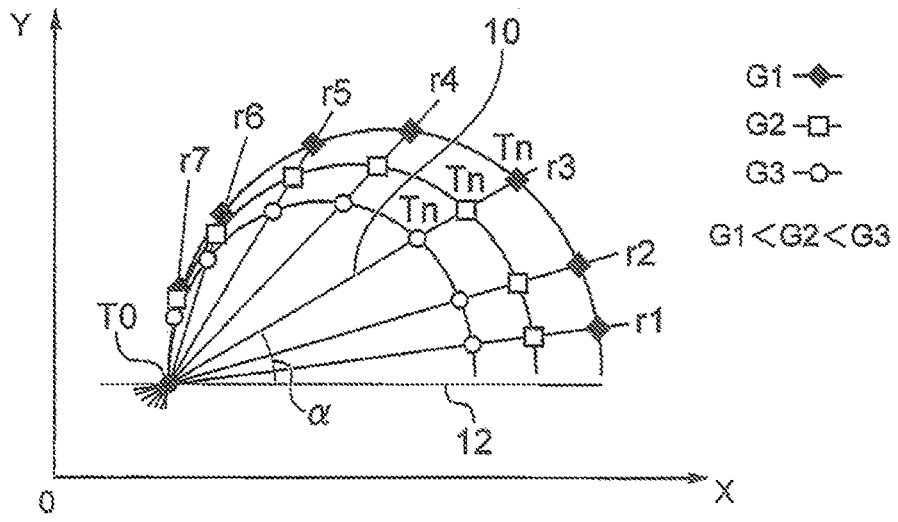
FIG. 11 is a graph illustrating how an arc-like track of coordinates X and Y changes in accordance with the distance corresponding to the thickness of a polishing pad used.

A distance G between the coil of the eddy current sensor 210 and the substrate W changes in accordance with the thickness of the polishing pad 310A interposed between them. As a result, as shown in FIG. 11, the arc-like track of the coordinates X and Y changes in accordance with the distance G (G1 to G3) corresponding to the thickness of the polishing pad 310A used. As is seen from FIG. 11, regardless of the distance G between the coil and the polishing target 102, the coordinates X and Y having the same film thickness are connected with a straight line (hereinafter referred to as equal film thickness straight line), the equal film thickness straight line intersects at a point of intersection P. The point P is the first point T0. This equal film thickness straight line rn (n: 1, 2, 3 . . . ) is inclined with respect to H (diameter of a circle passing through the first point in FIG. 11) by an angle α (impedance angle) according to the thickness of the conductive film (the polishing target 102). The diameter of the circle passing through the first point is the same regardless of the distance G.

The angle α is an angle formed between a first straight line connecting a first point (T0) corresponding to an impedance when the film thickness is zero and a second point (Tn) corresponding to an impedance when the film thickness is not zero (a straight line connecting the point on the impedance coordinate system corresponding to an impedance component and a predetermined reference point) and the diameter of a circle (a predetermined straight line) passing through the first point (T0). When the thickness of the conductive film is the same, the angle α is the same regardless of the difference in thickness of the polishing pad 310A. This will be described using FIG. 12. The predetermined straight line is also a straight line connecting the first point (T0) and the point T∞.

Figure 12:
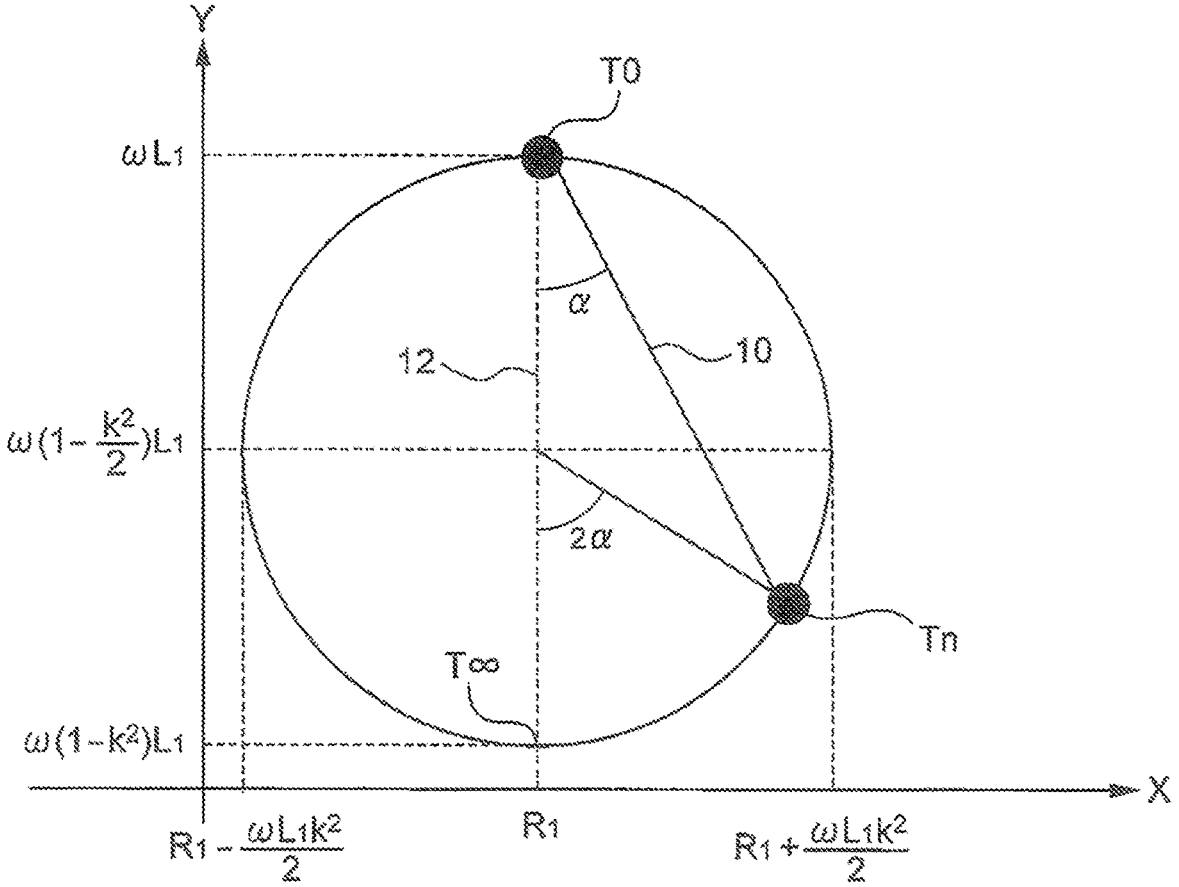
FIG. 12 is a diagram illustrating that an angle $\alpha$ remains the same despite the difference in thickness of the polishing pad.

The coordinates (X, Y) of the point Tn are expressed using the angle α shown in FIG. 12. From FIG. 12, $$X=R_1+\omega(k^2/2)L_1\sin\alpha \quad (12)$$

$$Y=\omega(1-(k^2/2)L_1-\omega(k^2/2)L_1\cos\alpha \quad (13)$$

From (8) and (9) above, $$R_2/L_2=\omega(X-R_1)/(\omega L_1-Y)$$

When (12) and (13) are substituted into this equation, $$R_2/L_2=\omega\sin 2\alpha/(1+\cos 2\alpha)=\omega\tan\alpha \quad (14)$$

Since $R_2/L_2$ depends on only the film thickness, and does not depend on the coupling coefficient k, $R_2/L_2$ does not depend on the distance between the eddy current sensor 210 and the polishing target 102, that is, the thickness of the polishing pad 310A. $R_2/L_2$ depends on only the film thickness, and so the angle α also depends on only the film thickness. The film thickness calculation unit calculates the tangent of the angle α and calculates the film thickness from the tangent using the relationship in (14).

The method of calculating the angle α and the method of calculating the film thickness will be described. In order to measure the film thickness of the polishing target, the film thickness measuring apparatus 231 in FIG. 2 receives an impedance as input from the receiving unit 232 when the eddy current sensor 210 detects an eddy current which can be formed in the polishing target 102 as an impedance. The film thickness is calculated from the inputted impedance. The film thickness measuring apparatus 231 is provided with an angle calculation unit 234 and a film thickness calculation unit 238.

First, the angle calculation unit 234 determines the center of the circle from three measuring points of the impedance component (three points corresponding to different film thicknesses) on the circle including the measured first point T0. The angle calculation unit 234 calculates a diameter 12 passing through the center of the circle from the first point T0 and the center of the circle. The angle calculation unit 234 calculates the angle α formed by the first straight line 10 connecting the first point T0 corresponding to the impedance when the film thickness is zero and the second point Tn corresponding to the impedance when the film thickness is not zero, and the diameter 12 of the circle passing through the first point T0. The film thickness calculation unit 238 calculates the tangent of the angle α and obtains the film thickness from the tangent.

Next, the film thickness calculation unit 238 that calculates the film thickness from the tangent will be described. The present embodiment uses a relationship between the reciprocal of the tangent and the film thickness. First, the relationship between the reciprocal of the tangent and the film thickness will be described.

When the film thickness is large, the aforementioned relationship (14) exists between the tangent and the resistance value of the metal film, that is, $$R_2/L_2=\omega \tan \alpha \quad (14)$$

where $R_2$ is a resistance value of the metal film. Therefore, $R_2$ is proportional to tan α. Furthermore, when the film thickness is large, $R_2$ has the following relationship with the film thickness.

$$R_2=\mu L/tW \quad (15)$$

where ρ: resistivity, L, W: length and width of metal film, t: film thickness

From (14) and (15), it is seen that the film thickness t and the angle α have the following relationship.

$$R_2 \propto (1/t) \propto \omega \tan \alpha$$

That is, 1/tan α∝t

From this, 1/tan α is proportional to the film thickness t. When the film thickness is small, (15) does not hold, and so the relationship between 1/tan α and the film thickness t is expressed by a non-linear relationship. The method of calculating the film thickness when the relationship is expressed by a non-linear relationship will be described next.

First, the eddy current sensor 210 and the receiving unit 232 obtains the resistance component (X) and the reactance component (X) on the impedance coordinate plane. Next, the angle calculation unit 234 calculates tan α using the aforementioned method. The relationship between 1/tan α and the film thickness t is expressed by a non-linear relationship. The film thickness calculation unit 238 calculates the film thickness t from 1/tan α using the following non-linear relationship.

1/tan α (=Ta) and the film thickness t have a non-linear function, that is, a relationship expressed by:

film thickness $t=A\times Ta\hat{}2+B\times Ta+C$ (quadratic function of reciprocal *Ta* of tangent)

or film thickness $t=A\times(e\hat{}(B\times Ta)-1)+C$ (exponential function of reciprocal *Ta* of tangent)

Here, the non-linear function means a function other than a linear function of the reciprocal Ta. Note that the non-linear function is not limited to the above-described quadratic function of the reciprocal Ta or exponential function, but can be selected in accordance with the thickness, type or condition of the metal film. For example, the non-linear function may be a function expressed by a polynomial of third or higher order, a function not expressed by any polynomial (e.g., an irrational function, a logarithmic function) or the like. An arbitrary function expressing a non-linear relationship existing between Ta of the target metal film and film thickness t can be used as the non-linear function.

In addition, the non-linear function may be a polygonal line graph in which a plurality of functions expressed by a polynomial of first or higher order are connected. The non-linear function may be a function other than linear functions composed from an arbitrary combination of a function expressed by a polynomial of first or higher order and a function not expressed by a polynomial (e.g., functions obtained through addition, subtraction, multiplication and/or division).

Note that the method of expressing a non-linear function is not limited to the method whereby coefficients of respective orders of a quadratic function or coefficients of an exponential function or the like are stored in storage means as described above, but a correspondence relationship between the reciprocal Ta and the film thickness t may be stored in a table format. That is, the correspondence relationship between the reciprocal Ta and the film thickness t may not be expressed in the function format as described above. Note that information on the non-linear function (coefficients or the like), table or the like is obtained through an advance calibration performed prior to the measurement of the film thickness of the polishing target 102. The calibration will be described later.

Figure 13:
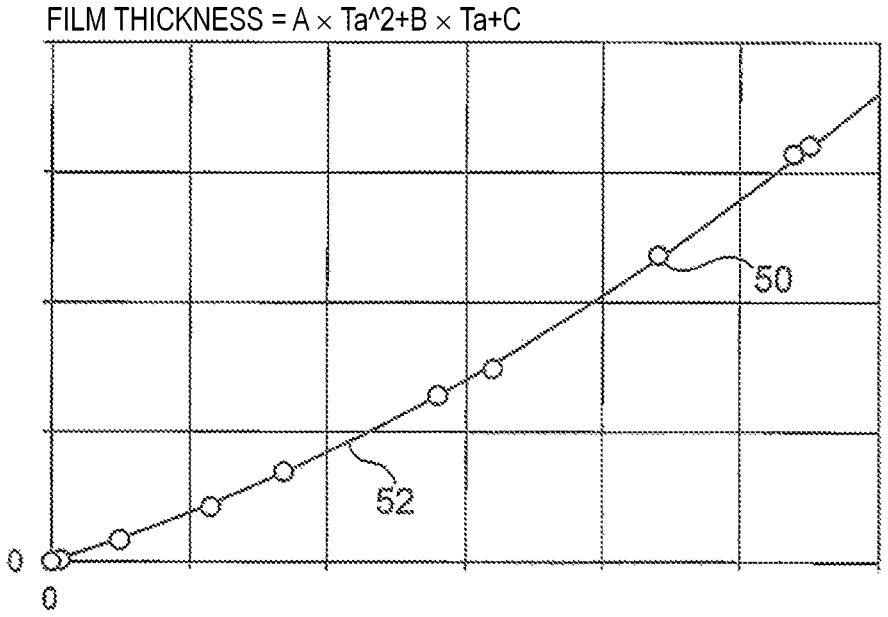
FIG. 13 is a diagram illustrating a non-linear relationship between 1/tan $\alpha$ (=Ta) and a film thickness t.
Figure 14:
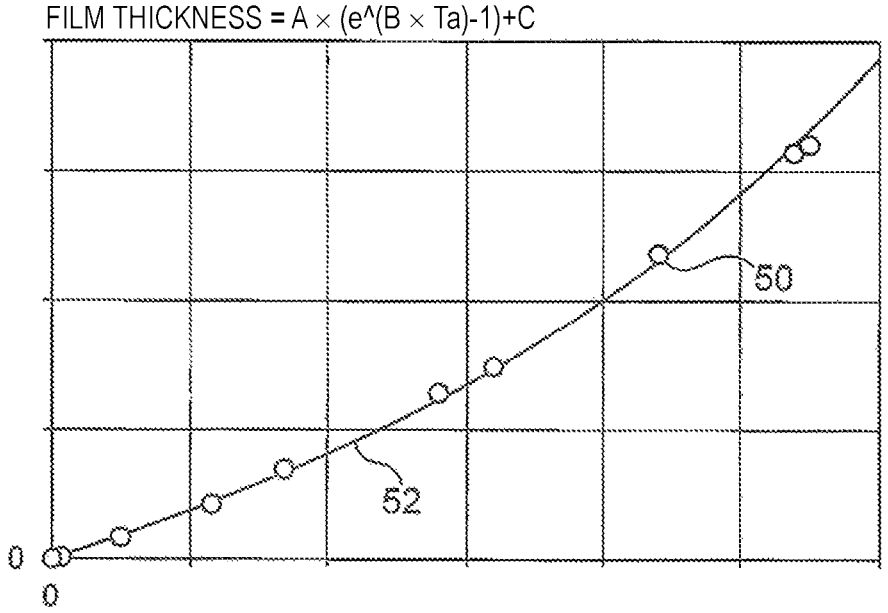
FIG. 14 is a diagram illustrating a non-linear relationship between 1/tan $\alpha$ (=Ta) and the film thickness t.

FIGS. 13 and 14 are diagrams illustrating examples of the actually measured non-linear relationship between 1/tan α (=Ta) and the film thickness t. The horizontal axis represents measured value 1/tan α (no unit) of the eddy current sensor 210 and the vertical axis represents film thickness t (unit is, for example, nm). In FIG. 13, there is a relationship of film thickness $t=A\times Ta\hat{}2+B\times Ta+C$ between Ta and film thickness t. In FIG. 14, there is a relationship of film thickness $t=A\times(e\hat{}(B\times Ta)-1)+C$ between Ta and film thickness t. In FIGS. 13 and 14, identical symbols A, B and C are used, but the values of A, B and C in FIG. 13 are normally different from the values of A, B and C in FIG. 14. In the measurement of the film thickness of the polishing target 102, either one or both of the two approximate equations can be used.

In FIGS. 13 and 14, circles 50 represent measured values, solid lines 52 represent respective values calculated according to approximate equations $t=A\times Ta\hat{}2+B\times Ta+C$ and $t=A\times(e\hat{}(B\times Ta)-1)+C$. In FIGS. 13 and 14, the measured values are identical and the identical measured values are respectively expressed according to two approximate equations $t=A\times Ta\hat{}2+B\times Ta+C$ and $t=A\times(e\hat{}(B\times Ta)-1)+C$. Both approximate equations reproduce the measured values accurately. Note that the two different approximate equations $t=A\times Ta\hat{}2+B\times Ta+C$ and $t=A\times(e\hat{}(B\times Ta)-1)+C$ generally cannot always reproduce the identical measured values accurately.

Furthermore, it is seen from FIGS. 13 and 14 that the measured values do not satisfy a linear relationship. Note that in FIGS. 13 and 14, since the measured values include a case where the film thickness is "0," Ta=0 and film thickness t=0 and C=0. C is generally not 0.

Regarding the respective coefficients in two approximate equation $t=A\times Ta\hat{}2+B\times Ta+C$ and $t=A\times(e\hat{}(B\times Ta)-1)+C$, when individual differences among a plurality of eddy current sensors 210 are small enough to be ignored, a value determined about one eddy current sensor 210 may be used for another eddy current sensor 210. To determine each coefficient more accurately, calibration may be actually performed for individual eddy current sensors 210.

The following will describe the calibration method for the eddy current sensor 210 disposed on the polishing table 320A to monitor the film thickness of a conductive film when polishing the conductive film on the substrate W. Examples of the calibration method include a method using three substrates W, a method using two substrates W, and a method using one substrate W. First, the method using three substrates W will be described.

Figure 15:
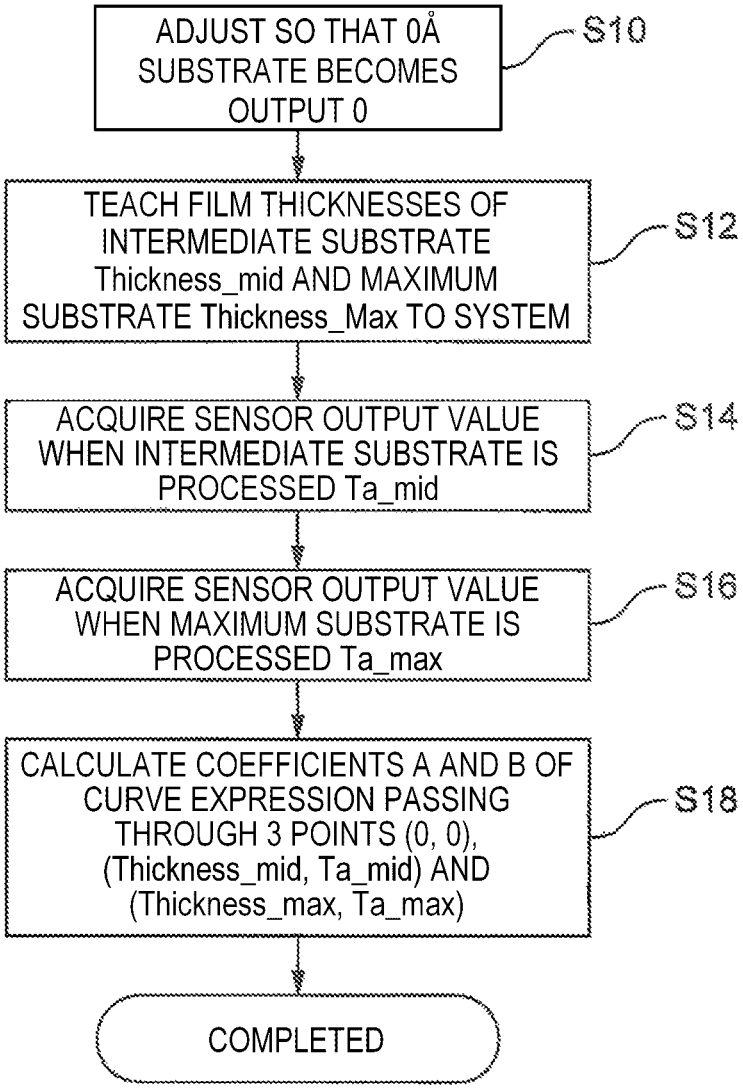
FIG. 15 illustrates a flowchart of a calibration method using three substrates.

FIG. 15 illustrates a flowchart of the calibration method using three substrates W. The three substrates W to be prepared are a substrate W having a minimum film thickness t among the three substrates W, a substrate W having an intermediate film thickness t and a substrate W having a maximum film thickness t. In order to determine a measured value of the eddy current sensor 210, the eddy current sensor 210 is polished using water instead of slurry so that the metal film is not scraped. The reciprocal Ta is then calculated from the output value of the eddy current sensor 210 as described above.

According to the present embodiment, it is possible to obtain the correspondence information indicating the non-linear relationship between the film thickness and the film thickness information from a minimum of three film thickness measuring points of the three substrates. Note that in the present embodiment, four or more pieces of film thickness information may be obtained from four or more substrates and the correspondence information indicating the non-linear relationship between the film thickness and the film thickness information may be obtained. It is thereby possible to improve the accuracy of the correspondence information compared to the case where the correspondence information is obtained from the three pieces of film thickness information: the first, second and third film thickness information.

In addition, the film thicknesses t of the three substrates W are measured in advance using a film thickness measuring machine 54. From the relationship between the reciprocal Ta obtained from the eddy current sensor 210 and the film thickness t measured using the film thickness measuring machine 54, the respective coefficients of the two approximate equations $t=A\times Ta^2+B\times Ta+C$ and $t=A\times(e^{(B\times Ta)}-1)+C$ are derived using the least squares method or the like. As one example of the film thickness of the substrate W used in the flowchart in FIG. 16, the film thickness t of the substrate W having the minimum film thickness t is 0 Å, the film thickness t of the substrate W having the intermediate film thickness t is 2 k to 3 kÅ and the film thickness t of the substrate W having the maximum film thickness t is 8 k to 10 kÅ.

The film thickness measuring machine 54 can be provided outside the polishing unit 300 as shown in FIG. 1. The film thickness measuring machine 54 can also be provided inside the polishing unit 300. As the film thickness measuring machine 54, an arbitrary publicly known measuring machine can be used as long as it can measure the film thickness t. Examples of such a film thickness measuring machine include an electromagnetic film thickness gauge, an eddy current film thickness gauge, an optical film thickness gauge, an electric resistance film thickness gauge and an eddy current phase film thickness gauge. The film thickness t can also be measured by observing a cross section using an electronic microscope.

The above-described procedure will be described more specifically using the flowchart in FIG. 15. In step S10, the first substrate W having a known first film thickness (minimum film thickness), the second substrate W having a known second film thickness (intermediate film thickness), and the third substrate W having a known third film thickness (maximum film thickness) are prepared. The first film thickness, the second film thickness and the third film thickness are different from one another. The first film thickness, the second film thickness and the third film thickness are measured in advance using the film thickness measuring machine 54. Regarding the first film thickness, if the film thickness is known to be 0, the film thickness need not be measured in advance using the film thickness measuring machine 54. The case where the film thickness is known to be 0 is, for example, a case where it is known that the film forming step has not been performed.

The 0 Å substrate (first substrate W) is disposed in the first polishing unit 300A and measurement is performed using the eddy current sensor 210. The measurement result is processed using the angle calculation unit 234 and the film thickness calculation unit 238 as described above, and the reciprocal Ta which is the sensor output value at the time of measurement is stored in the film thickness calculation unit 238. The film thickness calculation unit 238 adjusts the measuring circuit of the eddy current sensor 210 and the film thickness measuring apparatus 231 so that the reciprocal Ta obtained from the output of the eddy current sensor 210 at this time becomes "0" (first film thickness information). The reason for making such an adjustment is that there may be a case where the reciprocal Ta obtained from the output of the eddy current sensor 210 does not become "0" due to the characteristic of the measuring circuit or the like.

In step S10 and the following steps S14 and S16, the substrate W, a film thickness of which has been measured in advance, is polished using water while rotating the polishing table 320A. This will be referred to as "water polishing" hereinafter. In the case of "water polishing," since water is used, polishing does not actually occur. The reason for performing "water polishing" is that since it is an object to obtain the output of the eddy current sensor 210 at this time using the polishing target 102, a film thickness of which is known, it is not desirable that polishing be performed.

In step S12, the film thicknesses such as the known film thickness (Thickness_mid) of the second substrate W (intermediate substrate), the known film thickness (Thickness_Max) of the third substrate W (maximum substrate) are taught to the film thickness calculation unit 238 (system). More specifically, for example, the user inputs the known film thickness from an input part (not shown). The known film thickness may be stored in advance in a storage unit of the first polishing unit 300A.

In step S14, the intermediate substrate (second substrate W) is disposed in the first polishing unit 300A, and measurement is performed using the eddy current sensor 210. The measurement result is processed using the angle calculation unit 234 and the film thickness calculation unit 238 as described above and the reciprocal Ta (second film thickness information: Ta_mid) obtained from the output of the eddy current sensor 210 at the time of measurement is stored in the film thickness calculation unit 238.

In step S16, the maximum substrate (third substrate W) is disposed in the first polishing unit 300A, and measurement is performed using the eddy current sensor 210. The measurement result is processed using the angle calculation unit 234 and the film thickness calculation unit 238 as described above and the reciprocal Ta (third film thickness information: Ta_max) obtained from the output of the eddy current sensor 210 at the time of measurement is stored in the film thickness calculation unit 238.

In step S18, the film thickness calculation unit 238 obtains the correspondence information (the above-described approximate equation) indicating the non-linear relationship between the first, second and third film thicknesses and the corresponding first, second and third film thickness information from the first, second and third film thicknesses, and the first, second and third film thickness information. More specifically, in FIG. 13 or FIG. 14, the coefficients A and B of either one or both of the two approximate equations described above passing through the three points of the coordinate point (0, 0), (Thickness_mid, Ta_mid) and (Thickness_max, Ta_max) is calculated. Note that the coefficient C is "0" in the present embodiment.

Note that the first, second and third film thickness information may be obtained by statistically processing (average processing or the like) the plurality of first, second and third pieces of film thickness information obtained by measuring identical points or different points on the substrates W a plural number of times for the first, second and third film thicknesses.

Next, calibration in the case where a plurality of eddy current sensors 210 are mounted on one polishing table 320A will be described. In this case, as a first method, the calibration shown in FIG. 15 is performed on the plurality of eddy current sensors 210 simultaneously. That is, this is a method of simultaneously performing calibration for each sensor using three identical substrates W.

As a second method, when the plurality of eddy current sensor 210 are mounted on one polishing table 320A, calibration is performed on the three identical substrates W, but one or more selected eddy current sensors 210 are used as a reference and the calibration results of the other eddy current sensors 210 are matched to the eddy current sensor 210 used as a reference. In this case, it is possible to correct errors among the sensors.

The second method is intended to reduce calibration errors among the eddy current sensors 210 when the plurality of eddy current sensors 210 are mounted on one polishing table 320A. This method is intended to solve the following problems.

When there are an eddy current sensor 210 for measuring places in the vicinity of the center of the substrate W and an eddy current sensor 210 for measuring places not in the vicinity of the center of the substrate W, the film thickness at the position corresponding to each sensor is measured using the film thickness measuring machine 54. It is necessary to input the measured value to the film thickness calculation unit 238, which is complicated. The reason that it is necessary to measure the film thickness at the position corresponding to each sensor is as follows.

The eddy current sensor 210 for measuring places in the vicinity of the center of the substrate W measures in the vicinity of the center of the substrate W in every rotation of the polishing table 320A, and so it is possible to always measure the part of the same film thickness. On the other hand, the eddy current sensor 210 for measuring places not in the vicinity of the center of the substrate W normally measures a different part of the substrate W in every rotation of the polishing table 320A. There is a slight variation in film thickness for each position of the substrate W, and so the eddy current sensor 210 for measuring places not in the vicinity of the center of the substrate W is prone to errors in calibration. That is, if calibration is performed on the premise that the whole substrate W has the same film thickness, it may be possible to obtain a calibration result that film thicknesses which are actually different from one another are regarded as having the same film thickness.

This problem may also occur when one or more eddy current sensors 210 are mounted on each of different polishing tables 320A. The second method can reduce calibration errors among the eddy current sensors 210 in this case, too.

For simplicity, a case where two eddy current sensors 210 are disposed on the same polishing table 320A will be described. In this case, positions of the first, second and third substrates measured by the first eddy current sensor 210 for measuring places in the vicinity of the center of the substrate W are different from positions of the first, second and third substrates measured by the second eddy current sensor 210 for measuring places not in the vicinity of the center of the substrate W.

In order to solve this problem, the calibration in FIG. 15 is performed for the first eddy current sensor 210 serving as a reference. That is, the film thickness at the calibration position of the first eddy current sensor 210 is inputted to the film thickness calculation unit 238 and the calibration is performed as shown in FIG. 15. When calibration is in progress, the first eddy current sensor 210 and the second eddy current sensor 210 perform measurement respectively, and the film thickness calculation unit 238 acquires the reciprocal Ta for each sensor.

After that, the first eddy current sensor 210 serving as a reference performs calibration calculation and calculates the above-described approximate equation. The first eddy current sensor 210 performs measurement at the measurement position of the second eddy current sensor 210 and the film thickness calculation unit 238 obtains the reciprocal Ta at the position. The first eddy current sensor 210 can perform measurement at the measurement position of the second eddy current sensor 210 because the first eddy current sensor 210 that measures places in the vicinity of the center of the substrate W can normally measure substantially the whole region on the substrate W while the polishing table 320A rotates several times.

Next, the film thickness calculation unit 238 calculates the film thickness at the measurement position of the second eddy current sensor 210 according to the approximate equation of the first eddy current sensor 210 serving as a reference. For this reason, the film thickness calculation unit 238 obtains information relating to the measurement position of the second eddy current sensor 210 from the user or calculates the measurement position of the second eddy current sensor 210 from rotation information of the polishing table 320A and the top ring 330A.

The above-described approximate equation relating to the second eddy current sensor 210 is calculated using the film thickness calculated using the first eddy current sensor 210 serving as a reference and the reciprocal Ta measured by the second eddy current sensor 210 itself.

Note that although it is assumed in the above description that the positions of the two sensors are different, the second method is applicable even when the positions of the two sensors are substantially the same. In this case, when characteristics of the two sensors are different, it is possible to cause the measured film thicknesses to precisely match.

The second method is more specifically performed as follows. In order to monitor the film thickness of the conductive film, the second eddy current sensor 210 is disposed on the polishing table 320A. For each of the above-described first, second and third substrates, the second eddy current sensor 210 measures the first, second and third substrates, and the angle calculation unit 234 and the film thickness calculation unit 238 obtain fourth, fifth and sixth reciprocals Ta from an impedance component of the output of the second eddy current sensor 210. For each of the first, second and third substrates, the first eddy current sensor 210 measures the first, second and third substrates at the positions of the first, second and third substrates to be measured by the second eddy current sensor 210, and the angle calculation unit 234 and the film thickness calculation unit 238 obtain seventh, eighth and ninth reciprocals Ta.

Using the correspondence information (approximate equation) obtained about the first eddy current sensor 210, the film thickness calculation unit 238 calculates fourth, fifth and sixth film thicknesses from the seventh, eighth and ninth reciprocals Ta. The film thickness calculation unit 238 obtains correspondence information indicating a non-linear relationship between the reciprocal Ta and the film thickness of the second eddy current sensor 210 indicating a relationship between the fourth, fifth and sixth film thicknesses and the corresponding fourth, fifth and sixth reciprocals Ta from the fourth, fifth and sixth film thicknesses and the fourth, fifth and sixth reciprocals Ta.

Figure 16:
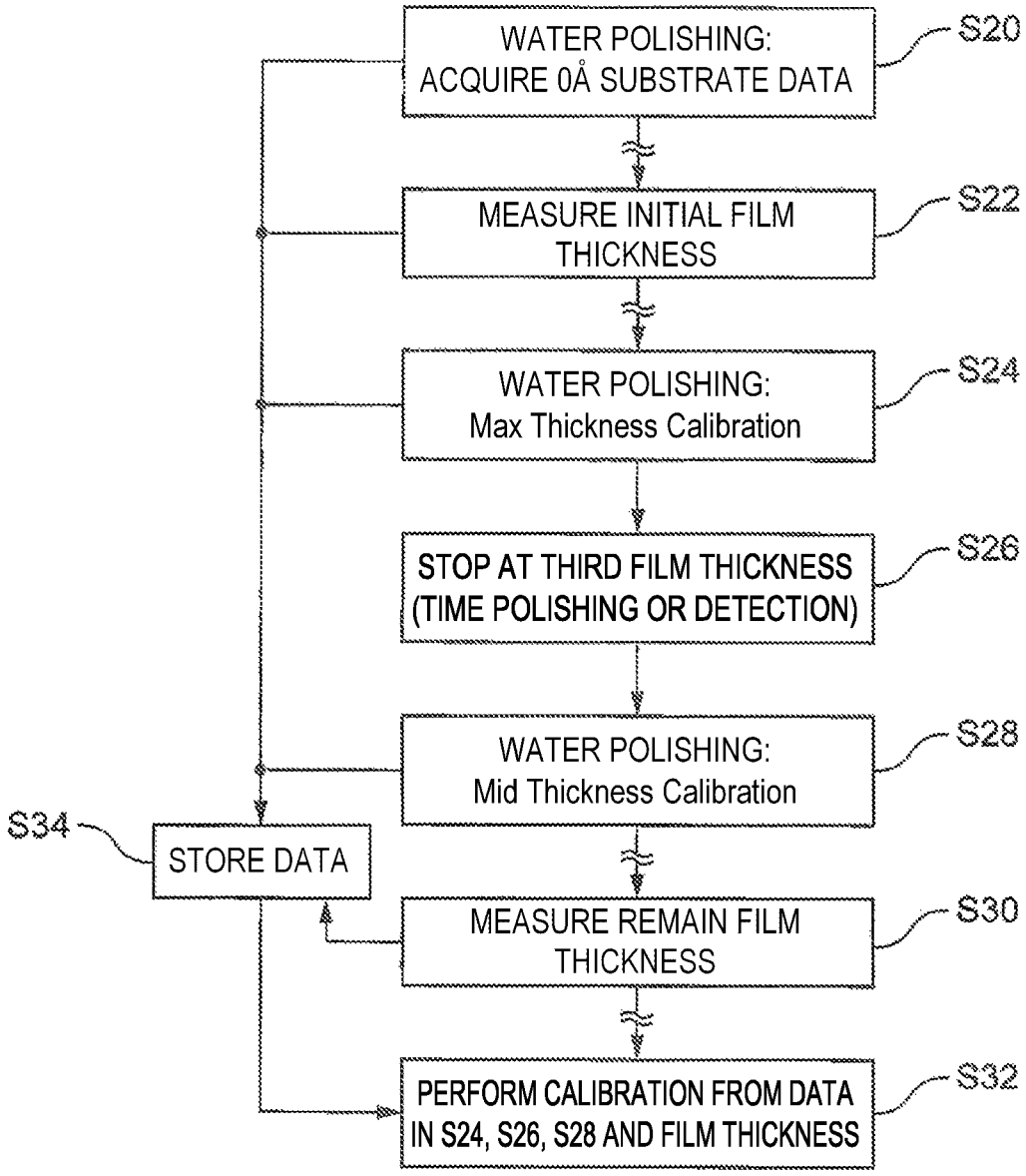
FIG. 16 illustrates a flowchart of a calibration method using two substrates.

Next, the calibration method using two substrates W will be described. FIG. 16 illustrates a flowchart of the method using two substrates W. The two substrates W to be prepared are a substrate W having a minimum film thickness t (first film thickness, for example, 0 Å) and a substrate W having a maximum film thickness t (second film thickness). Use of two substrates W makes it possible to reduce time and effort in creating a metal film compared to preparing three or more substrates W having a metal film.

The present embodiment may also be configured to prepare two or more first substrates having a first film thickness, that is, two or more substrates not to be polished in calibration and obtain a plurality of pieces of first film thickness information. At this time, the first film thickness preferably differs among a plurality of first substrates. Furthermore, the present embodiment may also be configured to prepare two or more second substrates having a second film thickness, that is, two or more substrates to be polished in calibration and obtain a plurality of pieces of second and third film thickness information. At this time, the second and third film thicknesses preferably differ among the plurality of second substrates. Providing the first, second and third film thickness information, each of which is made up of a plurality of pieces of film thickness information can increase the accuracy of the correspondence information compared to the case where three pieces of film thickness information: the first, second and third film thickness information, each of which is made up of one piece of film thickness information are provided.

Note that after obtaining the second substrate having the third film thickness, the second substrate having the second film thickness may be further polished at least one or more times to obtain second substrates having fourth, fifth, . . . film thicknesses and obtain fourth, fifth, . . . film thickness information. In order to obtain correspondence information indicating a non-linear relationship, a minimum of first, second and third film thicknesses and corresponding first, second and third film thickness information are necessary, and it is possible to increase the accuracy of correspondence information by obtaining fourth, fifth, . . . film thickness information. It is alright if a total of three or more film thicknesses and three or more corresponding pieces of film thickness information are obtained from the first substrate and the second substrate, and it may be possible to arbitrarily combine which of the first substrate or the second substrate or whether or not both substrates should be polished or the number of times the polishing step is executed or the like.

In the method shown in this diagram, the substrate W having the minimum film thickness t and the substrate W having the maximum film thickness t are measured in advance using the film thickness measuring machine 54. When the film thickness of the substrate W having the minimum film thickness t is 0, the substrate W need not be measured in advance using the film thickness measuring machine 54. Hereinafter, the film thickness of the substrate W having the minimum film thickness t is assumed to be 0. After measuring the film thickness of the substrate W having the maximum film thickness using the film thickness measuring machine 54, a substrate W corresponding to the substrate W having the intermediate film thickness t among the three substrates in FIG. 15 is created by finishing polishing at a specific film thickness (third film thickness) instead of shaving the substrate W having the maximum film thickness down to 0 Å. The substrate W having the intermediate film thickness is measured using the eddy current sensor 210 and a reciprocal Ta is acquired. After that, the film thickness t is measured using the film thickness measuring machine 54. The above-described approximate equation is obtained from the acquired data and the calibration is completed.

The reciprocal Ta of the substrate W having a film thickness of 0 Å may be acquired using the eddy current sensor 210 independently of the acquisition of the reciprocal Ta of the substrate W having a maximum film thickness using the eddy current sensor 210. "Independent acquisition" means that the acquisition need not be performed immediately following the "acquisition of Ta of the substrate W having the maximum film thickness using the eddy current sensor 210."

The acquisition of the reciprocal Ta of the substrate W having a film thickness of 0 Å using the eddy current sensor 210 may be performed after or before the acquisition of Ta of the substrate W having a maximum film thickness using the eddy current sensor 210. In FIG. 16, such acquisition is performed before acquisition of the reciprocal Ta of the substrate W having the maximum film thickness using the eddy current sensor 210 as step S20.

Note that instead of shaving the substrate W having the maximum film thickness down to 0 Å, polishing control so as to finish the polishing at a specific film thickness may be performed using the previous calibration result with respect to the eddy current sensor 210. When there is no data of the previous calibration result, polishing control may be performed using data relating to a similar eddy current sensor 210. A substrate W different from the substrate W having the maximum film thickness may be used for the substrate W having the film thickness of 0 Å.

The above-described procedure will be described more specifically using the flowchart in FIG. 16. In step S20, a first substrate having a known first film thickness and a second substrate having a known second film thickness are prepared. The first film thickness is different from the second film thickness.

In step S20, a 0 Å substrate (first substrate W) is disposed in the first polishing unit 300A and measurement is performed through "water polishing" using the eddy current sensor 210. The reciprocal Ta (first film thickness information) obtained from the output of the eddy current sensor 210 is stored in the film thickness calculation unit 238 (step S34).

In step S22, the second film thickness is measured using the film thickness measuring machine 54 disposed outside the substrate processing apparatus 1000. The film thicknesses obtained is stored in the film thickness calculation unit 238 (step S34). More specifically, for example, the user inputs the film thicknesses from an input unit (not shown) (or the film thickness is automatically inputted via a communication channel) to the film thickness calculation unit 238. The user may also store the film thickness (or the film thickness is automatically stored via a communication channel) in the storage unit of the first polishing unit 300A.

In step S24, the second substrate W having a second film thickness is disposed in the first polishing unit 300A and measured through "water polishing" using the eddy current sensor 210. The measurement result is processed using the angle calculation unit 234 and the film thickness calculation unit 238 as described above, and the reciprocal Ta (second film thickness information: Thickness_Max) obtained from the output of the sensor at the time of measurement is stored in the film thickness calculation unit 238 (step S34).

In step S26, polishing is performed using slurry. Polishing is performed, for example, until the film thickness reaches the third film thickness, and then polishing is stopped. Polishing may be controlled using a method of polishing for a predetermined time or using a method of detecting a film thickness using a previous calibration result as described above. A third substrate W having a third film thickness is obtained through polishing.

In step S28, measurement is performed through "water polishing" using the eddy current sensor 210. The measurement result is processed by the angle calculation unit 234 and the film thickness calculation unit 238 as described above, and the reciprocal Ta (third film thickness information: Thickness_mid) obtained from the output of the sensor at the time of measurement is stored in the film thickness calculation unit 238 (step S34).

In step S30, the third film thickness is measured using the film thickness measuring machine 54 disposed outside the substrate processing apparatus 1000. The film thickness obtained is stored in the film thickness calculation unit 238 (step S34). For example, the user inputs the film thickness from an input unit (not shown) (or the film thickness is automatically inputted via a communication channel) to the film thickness calculation unit 238. The user may store the film thickness (or the film thickness is automatically stored via a communication channel) in the storage unit of the first polishing unit 300A.

In step S32, the film thickness calculation unit 238 obtains correspondence information indicating a non-linear relationship between the first, second and third film thicknesses and the corresponding first, second and third film thickness information from the first, second and third film thicknesses and the first, second and third film thickness information. More specifically, in FIG. 14 or FIG. 15, coefficients A and B of either one or both of the above-described two approximate equations passing through the three points of coordinate point (0,0), (Thickness_mid, Ta_mid) and (Thickness_max, Ta_max) are calculated. Note that coefficient C is "0" in the present embodiment.

In other words, the method in FIG. 16 is a calibration method including:

measuring the first and second substrates using the first eddy current sensor 210 and obtaining first and second film thickness information from an impedance component of an output of the first eddy current sensor for the first and second substrates respectively (steps S20 and S24);

polishing the second substrate, obtaining the second substrate having a third film thickness (step S26), then measuring the second substrate using the first eddy current sensor 210 and obtaining third film thickness information from an impedance component of the output of the first eddy current sensor (step S28);

measuring a film thickness of the second substrate after polishing using the film thickness measuring machine 54 and obtaining the third film thickness (step S30); and obtaining correspondence information indicating a non-linear relationship between the first, second and third film thicknesses and the corresponding first, second and third film thickness information from the first, second and third film thicknesses and the first, second and third film thickness information (step S32).

Next, in the calibration method using two substrates W, calibration in the case where a plurality of eddy current sensors 210 are mounted on one polishing table 320A will be described. In this case, as a first method, the calibration shown in FIG. 16 is performed simultaneously on the plurality of eddy current sensors 210. That is, this is a method of performing calibration on two identical substrates W simultaneously for each sensor.

As a second method, when a plurality of eddy current sensors 210 are mounted on one polishing table 320A, calibration is performed on two identical substrates W and one or more selected eddy current sensors 210 are used as a reference and the calibration results of the other eddy current sensors 210 are adjusted to the eddy current sensor 210 serving as a reference. In this case, it is possible to correct errors among the sensors.

It is an object of the second method to solve the above-described problem, that is, to reduce calibration errors among a plurality of eddy current sensors 210 when the plurality of eddy current sensors 210 are mounted on one polishing table 320A.

It is assumed that two eddy current sensors 210 are disposed on the same polishing table 320A. In this case, positions of the first and second substrates measured by the first eddy current sensor 210 for measuring places in the vicinity of the center of the substrate W are different from positions of the first and second substrates measured by the second eddy current sensor 210 for measuring places not in the vicinity of the center of the substrate W.

In order to solve this problem, the first eddy current sensor 210 serving as a reference is subjected to the calibration in FIG. 16. That is, the film thickness at the calibration position of the first eddy current sensor 210 is inputted to the film thickness calculation unit 238, and calibration is performed as shown in FIG. 16. During calibration, the first eddy current sensor 210 and the second eddy current sensor 210 perform measurements respectively, and the film thickness calculation unit 238 acquires a reciprocal Ta for each sensor.

After that, the first eddy current sensor 210 serving as a reference performs calibration calculation to calculate the above-described approximate equation. The film thickness calculation unit 238 calculates the film thickness corresponding to the measurement position of the second eddy current sensor 210 using the first eddy current sensor 210 serving as a reference. For this purpose, the film thickness calculation unit 238 obtains information relating to the measurement position of the second eddy current sensor 210 from the user or calculates the measurement position of the second eddy current sensor 210 from rotation information of the polishing table 320A and the top ring 330A.

The above-described approximate equation relating to the second eddy current sensor 210 is calculated using the film thickness calculated using the first eddy current sensor 210 serving as a reference and the reciprocal Ta measured and obtained by the second eddy current sensor 210.

Note that although the positions of the two sensors are assumed to be different from each other in the above, the second method is applicable even when the positions of the two sensors are substantially the same. In this case, when characteristics of the two sensors are different from each other, the film thicknesses can be matched precisely.

The second method is more specifically performed as follows. In order to monitor the film thickness of the conductive film, the second eddy current sensor 210 is disposed on the polishing table 320A. For each of the above-described first substrate and the above-described second substrate before polishing, the second eddy current sensor 210 measures the first and second substrates and the angle calculation unit 234 and the film thickness calculation unit 238 obtain fourth and fifth film thickness information from an impedance component of the output of the second eddy current sensor 210.

For the second substrate after polishing, the second eddy current sensor 210 measures the second substrate, and the angle calculation unit 234 and the film thickness calculation unit 238 obtain sixth film thickness information from an impedance component of the output of the second eddy current sensor. For each of the first substrate and the second substrate having second and third film thicknesses, the first eddy current sensor measures the first and second substrates at the positions of the first and second substrates at which the second eddy current sensor measures the first and second substrates, and the angle calculation unit 234 and the film thickness calculation unit 238 obtain seventh, eighth and ninth film thickness information.

Using the correspondence information (above-described approximate equation) obtained for the first eddy current sensor, the fourth, fifth and sixth film thicknesses are calculated from the seventh, eighth and ninth film thickness information. The correspondence information (above-described approximate equation) indicating a non-linear relationship between film thickness information and the film thickness of the second eddy current sensor 210 indicating a relationship between the fourth, fifth and sixth film thicknesses and the corresponding fourth, fifth and sixth film thickness information is obtained from the fourth, fifth and sixth film thicknesses and the fourth, fifth and sixth film thickness information.

Figure 17:
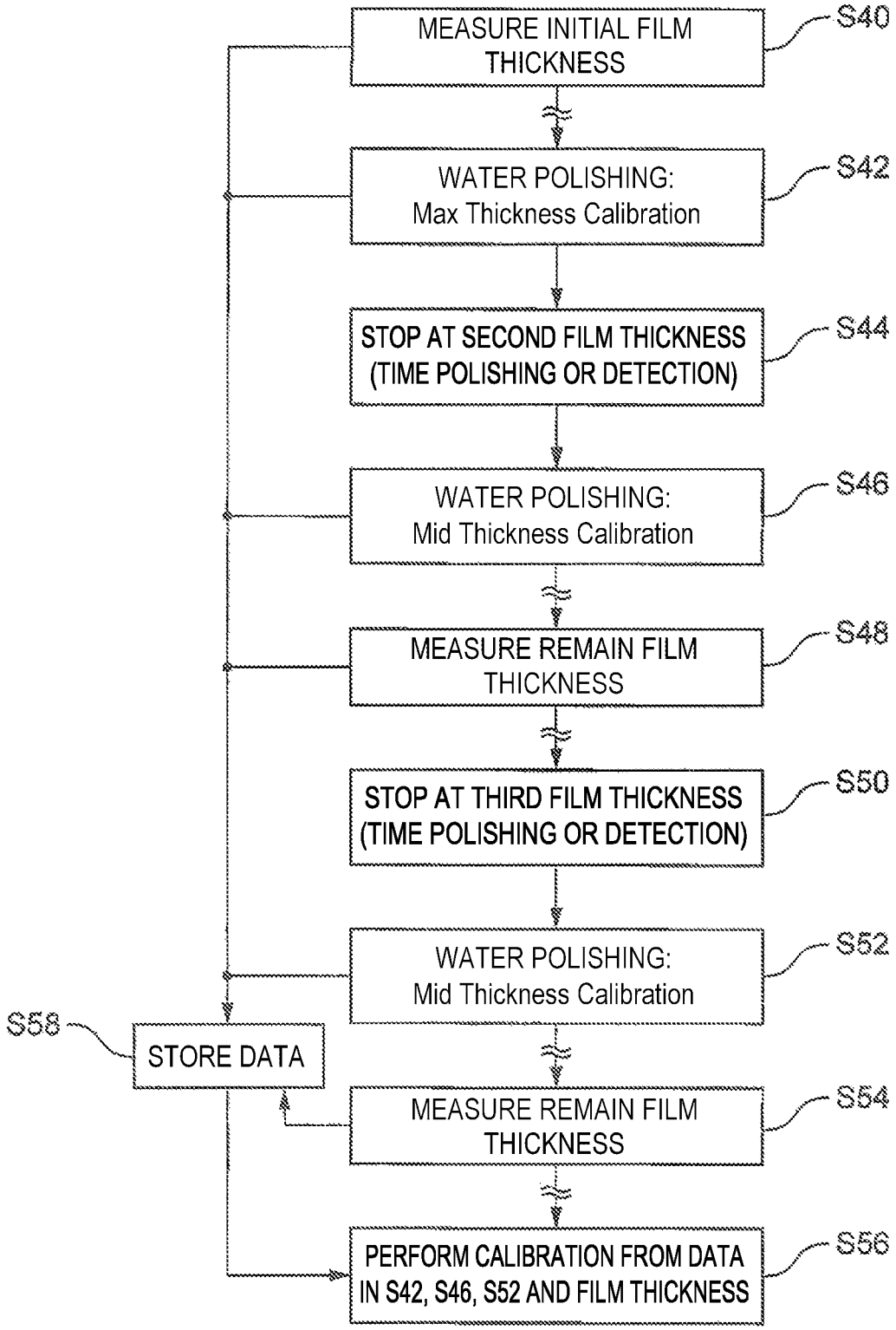
FIG. 17 illustrates a flowchart of a calibration method using one substrate.

Next, the calibration method using one substrate W will be described. FIG. 17 illustrates a flowchart of the method using one substrate W. The one substrate W to be prepared is a substrate W having a film thickness t. Using one substrate W can reduce time and effort in creating a metal film compared to the case where two or more substrates W having a metal film are prepared.

In the present embodiment, two or more first substrates having a first film thickness may be prepared to obtain a plurality of first, second and third pieces of film thickness information. Providing the first, second and third film thickness information, each of which is made up of a plurality of pieces of film thickness information can increase the accuracy of the correspondence information compared to the case where three pieces of film thickness information: the first, second and third film thickness information, each of which is made up of one piece of film thickness information are provided. Furthermore, after obtaining the substrate having the third film thickness, polishing may be further performed at least one or more times to obtain substrates having fourth, fifth, . . . film thicknesses to obtain fourth, fifth, . . . film thickness information.

In the method shown in this diagram, the film thickness t of the substrate W which is a first film thickness is measured in advance using the film thickness measuring machine 54. After measuring the film thickness of the substrate W using the film thickness measuring machine 54, substrates W corresponding to the substrates W having the intermediate film thickness t (second film thickness) and the minimum film thickness t (third film thickness) are created among the three substrates in FIG. 15 by finishing polishing at a specific film thickness instead of shaving the substrate W down to 0A. The substrates W having the intermediate and minimum film thicknesses are measured using the eddy current sensor 210 and reciprocals Ta are acquired. After that, the film thickness t is measured using the film thickness measuring machine 54. The above-described approximate equation is obtained from the film thickness and reciprocal Ta obtained and the calibration is thereby completed.

Note that instead of shaving the substrate W having the maximum film thickness down to 0A, polishing control so as to finish the polishing at a specific film thickness may be performed using the previous calibration result with respect to the eddy current sensor 210. When there is no data of the previous calibration result, polishing control may be performed using data relating to a similar eddy current sensor 210.

The above-described procedure will be described more specifically using a flowchart in FIG. 17. In step S40, a first substrate having a known first film thickness is prepared. In step S40, the first film thickness is measured using the film thickness measuring machine 54 disposed outside the substrate processing apparatus 1000. The film thickness obtained is stored in the film thickness calculation unit 238 (step S58). More specifically, for example, the user inputs the film thickness from an input unit (not shown) (or the film thickness is automatically inputted via a communication channel) to the film thickness calculation unit 238. The user may store the film thickness (or the film thickness may be automatically stored via a communication channel) in the storage unit of the first polishing unit 300A.

In step S42, the first substrate W having the first film thickness is disposed in the first polishing unit 300A and measurement is performed through "water polishing" using the eddy current sensor 210. The measurement result is processed using the angle calculation unit 234 and the film thickness calculation unit 238 as described above and the reciprocal Ta (first film thickness information: Thickness_Max) obtained from the output of the sensor at the time of measurement is stored in the film thickness calculation unit 238 (step S58).

In step S44, polishing is performed using slurry. The polishing is performed, for example, until the film thickness reaches the second film thickness and the polishing is then stopped. Polishing may be controlled using a method of polishing for a predetermined time or a method of detecting a film thickness using a previous calibration result as described above. The second substrate W having a second film thickness is obtained by polishing.

In step S46, measurement is performed through "water polishing" using the eddy current sensor 210. The measurement result is processed using the angle calculation unit 234 and the film thickness calculation unit 238 as described above, and the reciprocal Ta (second film thickness information: Thickness_mid) obtained from the output of the sensor at the time of measurement is stored in the film thickness calculation unit 238 (step S58). In step S48, the second film thickness is measured using the film thickness measuring machine 54 disposed outside the substrate processing apparatus 1000. The film thickness obtained is stored in the film thickness calculation unit 238 (step S58).

In step S50, polishing is performed using slurry. The polishing is performed, for example, until the film thickness reaches the third film thickness and the polishing is then stopped. Polishing may be controlled using a method of polishing for a predetermined time or a method of detecting a film thickness using a previous calibration result as described above. A third substrate W having a third film thickness is obtained by polishing.

In step S52, measurement is performed through "water polishing" using the eddy current sensor 210. The measurement result is processed using the angle calculation unit 234 and the film thickness calculation unit 238 as described above, and the reciprocal Ta (third film thickness information: Thickness_mid) obtained from the output of the sensor at the time of measurement is stored in the film thickness calculation unit 238 (step S58). In step S54, the second film thickness is measured using the film thickness measuring machine 54 disposed outside the substrate processing apparatus 1000. The film thickness obtained is stored in the film thickness calculation unit 238 (step S58).

In step S56, the film thickness calculation unit 238 obtains correspondence information indicating a non-linear relationship between the first, second and third film thicknesses and the corresponding first, second and third film thickness information from the first, second and third film thicknesses and the first, second and third film thickness information (reciprocal Ta). More specifically, in FIG. 14 or FIG. 15, coefficients A and B of either one or both of the above-described two approximate equations passing through the three points of coordinate point (0,0), (Thickness_mid, Ta_mid) and (Thickness_max, Ta_max) are calculated. Note that coefficient C is "0" in the present embodiment.

In other words, the method in FIG. 17 is a calibration method including:

- measuring the substrate W using the first eddy current sensor 210 and obtaining first film thickness information from an impedance component of an output of the first eddy current sensor (step S42);
- polishing the substrate W and obtaining the substrate W having the second film thickness, then measuring the substrate W using the first eddy current sensor 210 and obtaining second film thickness information from an impedance component of the output of the first eddy current sensor (step S46);
- measuring a film thickness of the substrate having the second film thickness using the film thickness measuring machine and obtaining the second film thickness (step S48);
- polishing the substrate having the second film thickness, obtaining the substrate W having a third film thickness, then measuring the substrate W using the first eddy current sensor 210 and obtaining third film thickness information from an impedance component of the output of the first eddy current sensor 210 (step S52);
- measuring a film thickness of the substrate having the third film thickness using the film thickness measuring machine and obtaining the third film thickness (step S54); and
- obtaining correspondence information indicating a non-linear relationship between the first, second and third film thicknesses and the corresponding first, second and third film thickness information from the first, second and third film thicknesses and the first, second and third film thickness information (step S56).

Next, in the calibration method using one substrate W, calibration in the case where a plurality of eddy current sensors 210 are mounted on one polishing table 320A will be described. In this case, as a first method, the calibration shown in FIG. 17 is performed simultaneously on the plurality of eddy current sensors 210. That is, this is a method of performing calibration simultaneously on one identical substrate W for each sensor.

As a second method, when a plurality of eddy current sensors 210 are mounted on one polishing table 320A, calibration is performed on one identical substrate W and one or more selected eddy current sensors 210 are used as a reference and the calibration results of the other eddy current sensors 210 are adjusted to the eddy current sensor 210 serving as a reference. In this case, it is possible to correct errors among the sensors.

It is an object of the second method to solve the above-described problem, that is, to reduce calibration errors among a plurality of eddy current sensors 210 when the plurality of eddy current sensors 210 are mounted on one polishing table 320A.

In order to solve this problem, the first eddy current sensor 210 serving as a reference is subjected to the calibration in FIG. 17. That is, the film thickness at the calibration position of the first eddy current sensor 210 is inputted to the film thickness calculation unit 238, and the calibration is performed as shown in FIG. 17. During the calibration, the first eddy current sensor 210 and the second eddy current sensor 210 perform measurements respectively, and the film thickness calculation unit 238 acquires a reciprocal Ta for each sensor.

After that, the first eddy current sensor 210 serving as a reference performs calibration calculation to calculate the above-described approximate equation. The film thickness calculation unit 238 calculates the film thickness corresponding to the measurement position of the second eddy current sensor 210 using the first eddy current sensor 210 serving as a reference. For this purpose, the film thickness calculation unit 238 obtains information relating to the measurement position of the second eddy current sensor 210 from the user or calculates the measurement position of the second eddy current sensor 210 from rotation information of the polishing table 320A and the top ring 330A. The above-described approximate equation relating to the second eddy current sensor 210 is calculated using the film thickness calculated using the first eddy current sensor 210 serving as a reference and Ta measured by the second eddy current sensor 210 itself.

The second method is more specifically performed as follows. In order to monitor the film thickness of the conductive film, the second eddy current sensor 210 is disposed on the polishing table 320A. For the substrate W having the first film thickness, the second eddy current sensor 210 measures the substrate W and the angle calculation unit 234 and the film thickness calculation unit 238 obtain fourth film thickness information from an impedance component of the output of the second eddy current sensor 210.

For the substrate having the second film thickness, the second eddy current sensor 210 measures the substrate W, the angle calculation unit 234 and the film thickness calculation unit 238 obtain fifth film thickness information from an impedance component of the output of the second eddy current sensor. For the substrate W having the third film thickness, the second eddy current sensor 210 measures the substrate W, and the angle calculation unit 234 and the film thickness calculation unit 238 obtain sixth film thickness information from an impedance component of the output of the second eddy current sensor.

For each of the substrates W having the first, second and third film thicknesses, the first eddy current sensor 210 measures the substrates W at the positions of the substrates W at which the second eddy current sensor 210 measures the substrates W and obtains seventh, eighth and ninth film thickness information. Using the correspondence information (above-described approximate equation) obtained for the first eddy current sensor 210, the film thickness calculation unit 238 calculates fourth, fifth and sixth film thicknesses from the seventh, eighth and ninth film thickness information.

The film thickness calculation unit 238 obtains correspondence information (above-described approximate equation) indicating a non-linear relationship between the film thickness information and the film thickness of the second eddy current sensor 210 indicating a relationship between the fourth, fifth and sixth film thicknesses and the corresponding fourth, fifth and sixth film thickness information from the fourth, fifth and sixth film thicknesses and the fourth, fifth and sixth film thickness information.

Next, an example will be described where the first polishing unit 300A includes the temperature sensor 56 that can directly or indirectly measure the temperature of a substrate W under polishing and the end point detector 241 (temperature correction unit) that can correct the film thickness obtained using the measured temperature. The first polishing unit 300A includes the temperature sensor 56 for monitoring the temperature in the first polishing unit 300A. In FIG. 2, the temperature sensor 56 is disposed so as to monitor the temperature of the polishing pad 310A or the substrate W on the polishing pad 310A. The temperature sensor 56 may also be disposed inside the top ring 330A so as to measure the temperature of the substrate W. The temperature sensor 56 may also be in direct contact with the surface of the polishing pad 310A or the substrate W so as to monitor the temperature of the surface of the polishing pad 310A or the substrate W. The temperature sensor 56 may also be a non-contact sensor (e.g., infrared sensor). The temperature is used when measuring a film thickness.

The present embodiment performs temperature correction. When the temperature of the metal film increases due to polishing, electrical conductivity decreases. The correspondence information is obtained in advance before polishing. The temperature of the metal film when obtaining the correspondence information is different from the temperature of the metal film when performing polishing after that and obtaining the film thickness using the correspondence information. Therefore, the temperature during measurement of the film thickness using the correspondence information may be higher or lower than the temperature when the correspondence information is obtained in advance. When the temperature is higher, the film thickness is measured to be less than the actual film thickness. More accurate film thickness values can be calculated by correcting the measured value of the film thickness using the temperature obtained using a temperature sensor that can directly or indirectly measure the temperature of the substrate.

The reason for correcting film thickness calculation using the temperature of the polishing pad 310A is as follows. Regarding the metal film on the substrate W, when the temperature of the substrate W rises, electrical conductivity thereof decreases. Therefore, at the time of the measurement of the eddy current sensor 210, the temperature of the substrate W generally rises from the temperature in calibration, and the film thickness may be erroneously measured as if it is smaller than the actual film thickness.

The film thickness can be calculated correctly by correcting erroneous measurement using the temperature of the polishing pad 310A. The end point detector 241 performs correction according to the following equation.

$$\text{Thickness_adj}=\text{Thickness}\times(1+k\times[(T-T\text{cal})\times\alpha+T])/(1+k\times T\text{cal}) \quad \text{(A1)}$$

where, Thickness_adj: film thickness t after correction

Thickness: film thickness t before correction

T: table temperature under polishing

Tcal: temperature of polishing pad 310A when eddy current sensor 210 is calibrated k: temperature coefficient of resistivity (metal-specific value)

α: coefficient dependent on first polishing unit 300A

For example, in the case of Cu in a bulk state (that is, Cu having somewhat large volume), k=0.0044 and when the temperature during calibration is 20° C., the film thickness of the metal film measured in an environment of 50° C. becomes 1/1.121 times. That is, the film thickness is measured approximately 4% less due to a temperature rise of 10° C.

The basis for the correction of film thickness calculation according to the above-described equation (A1) is as follows.

When the temperature of the metal is T, if the film thickness is assumed to be Thickness1, Thickness1 is expressed by the following equation.

$$\text{Thickness1}=\rho(T)/Rs$$

where ρ(T) is conductivity of the metal when the temperature of the metal is T, $$\rho(T)=\rho o(1+kT) \quad \text{(A2)}$$

ρo is conductivity of metal at temperature when calibration is performed

Rs is sheet resistance

When no temperature correction is performed, since the first polishing unit 300A has an approximate equation at the temperature during calibration, film thickness calculation is assumed to be performed at ρ(Tcal). Here, Tcal is a metal temperature during calibration.

However, when the temperature of the substrate W becomes T during polishing, the film thickness should be calculated using ρ(T). Therefore, the film thickness can be corrected according to the following equation.

$$\text{Adjusted Thickness}=\text{Calculated Thickness}\times\rho(T)\div\rho(T\text{cal})$$

where, Adjusted Thickness: film thickness corrected using ρ(T)

Calculated Thickness: film thickness before correction obtained according to approximate equation If this is expressed using T according to equation (A2), $$\text{Adjusted Thickness1}=\text{Calculated Thickness}\times(1+k\times T)/(1+k\times T\text{cal})$$

Furthermore, the temperature of the polishing pad 310A is basically lower than the temperature of the substrate W. To correct the temperature of the polishing pad 310A into the temperature of the substrate W, the system-dependent coefficient α is added so that the correction coefficient at Tcal becomes 1. The result is the above-described equation (A1).

$$\text{Thickness_adj}=\text{Thickness}\times(1+k\times[(T-T\text{cal})\times\alpha+T])/(1+k\times T\text{cal}) \quad \text{(A1)}$$

Next, an example of a configuration for handling information in the above-described first polishing unit 300A will be described using FIG. 18 to FIG. 20. However, in FIG. 18 to FIG. 20, the first polishing unit 300A is described simply and a more specific configuration (top ring 330A, polishing pad 310A or the like) is omitted.

Figure 18:
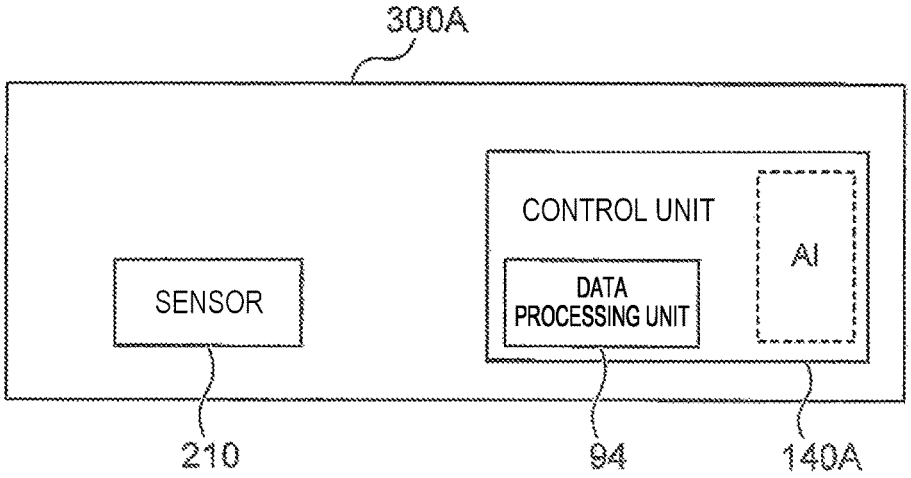
FIG. 18 is a block diagram illustrating control of a first polishing unit using AI.

FIG. 18 is a diagram illustrating an example of the first polishing unit 300A provided with a control unit 140A including a data processing unit 94. The data processing unit 94 may be mounted with an AI (Artificial Intelligence) function. The data processing unit 94 may be some hardware and may be a program stored, for example, in a storage medium. In FIG. 18, the data processing unit 94 is described as an element independent of other elements of the control unit 140A, but the data processing unit 94 may be stored, for example, in a storage device (not shown) provided for the control unit 140A and controlled by a processor (not shown) of the control unit 140A. The data processing unit 94 is configured to perform image processing and processing requiring large-scale computation such as generation and acquisition of a polishing profile, update of control parameters and feedback using real main signals as learning data. The configuration in FIG. 18 has an advantage that the first polishing unit 300A can be singly operated (as a standalone unit).

Figure 19:
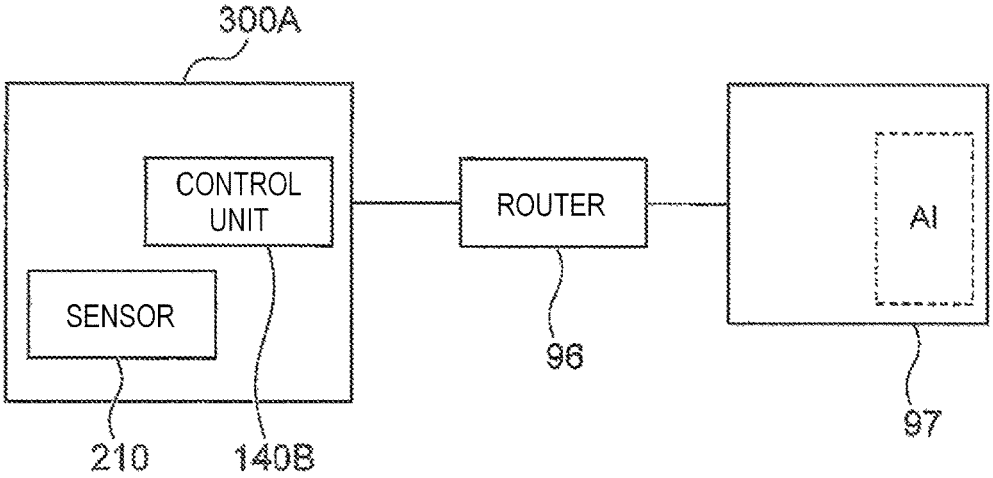
FIG. 19 is a block diagram illustrating control of the first polishing unit using AI.

FIG. 19 is an example of the first polishing unit 300A connected to a cloud (or fog) 97 via a router 96. The router 96 is an apparatus for connecting a control unit 140B to the cloud 97. The router 96 can also be called an "apparatus with a gateway function." The cloud 97 refers to a computer resource provided through a computer network such as the Internet. Note that when the connection between the router 96 and the cloud 97 is a local area network, the cloud may also be called "fog 97." For example, when connecting a plurality of factories scattered on the earth, the cloud 97 is used, and when constructing a network within a certain factory, the fog 97 may be used. The fog 97 may be further connected to an external fog or cloud. In FIG. 19, the control unit 140 and the router 96 are connected by cable, and the router 96 and cloud (or fog) 97 are connected by cable. However, each connection may also be a wireless connection. A plurality of first polishing units 300A are connected to the cloud 97 (not shown). Each of the plurality of first polishing units 300A is connected to the cloud 97 via the router 96. The data (film thickness data from the eddy current sensor 210 or any other information) obtained by each first polishing unit 300A is accumulated at the cloud 97. The cloud 97 in FIG. 19 may also have an AI function, and data is processed in the cloud 97. However, data may also be partially processed at the control unit 140B. The configuration in FIG. 19 has an advantage that the first polishing unit 300A can be controlled based on a large amount of accumulated data.

Figure 20:
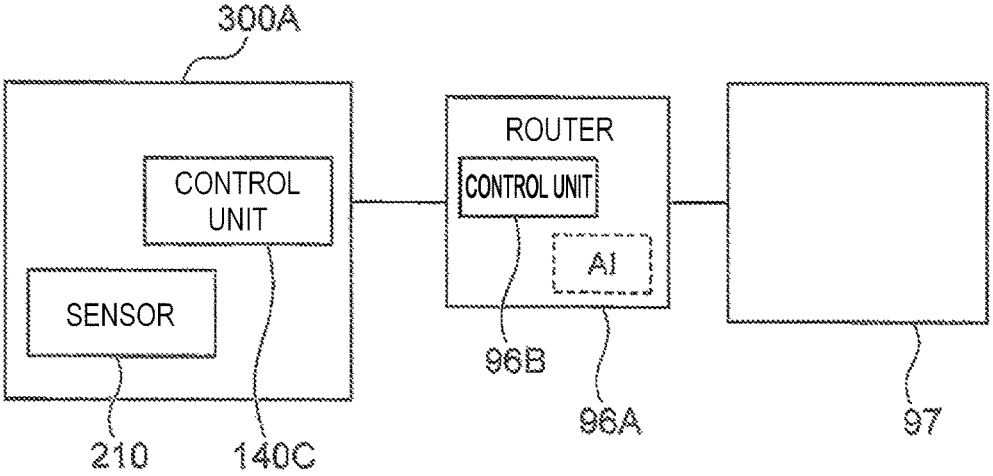
FIG. 20 is a block diagram illustrating control of the first polishing unit using AI.

FIG. 20 is a diagram illustrating an example of the first polishing unit 300A connected to the cloud (or fog) 97 via a router 96A having an edge computing function. The cloud 97 in FIG. 20 is also connected to a plurality of first polishing units 300A (not shown). Each of the plurality of first polishing units 300A in FIG. 20 is connected to the cloud 97 via the router 96A. However, some of the routers may not be provided with the edge computing function (some of the routers may be the routers 96 in FIG. 19). The router 96A is provided with a control unit 96B. However, FIG. 20 illustrates only one router 96A provided in the control unit 96B as a representative. Furthermore, an AI function may also be mounted on the router 96A. The AI functions of the control unit 96B and the router 96A can process data obtained from the control unit 140C of the first polishing unit 300A near the first polishing unit 300A. Note that the "nearness" referred to here is not a term that means a physical distance, but it is a term that refers to a distance on a network. However, if a distance on a network is small, the physical distance is often small too. Therefore, if the computation speed at the router 96A and the computation speed at the cloud 97 are on the same level, the processing at the router 96A is faster than the processing at the cloud 97. Even if there is a difference in the computation speed between the two, the speed at which information transmitted from the control unit 140C reaches the router 96A is faster than the speed at which information transmitted from the control unit 140C reaches the cloud 97.

The router 96A in FIG. 20 or more specifically, the control unit 96B of the router 96A processes only data requiring fast processing among data to be processed. The control unit 96B of the router 96A transmits data not requiring fast processing to the cloud 97. The configuration shown in FIG. 20 has an advantage that fast processing near the first polishing unit 300A is compatible with control based on accumulated data.

Although examples of the embodiments of the present invention have been described so far, the above-described embodiments of the invention are intended to facilitate an understanding of the present invention, but are not intended to limit the present invention. The present invention can be modified or improved without departing from the spirit and scope of the present invention and it goes without saying that the present invention includes equivalents thereof. The components described in the scope of the patent claims and the specification can be arbitrarily combined or omitted within the scope in which at least some of the aforementioned problems can be solved or within the scope in which at least some of the effects are exerted.

This application claims priority under the Paris Convention to Japanese Patent Application No. 2018-133604 filed on Jul. 13, 2018. The entire disclosure of Japanese Patent Laid-Open No. 2005-121616 including specification, claims, drawings and summary is incorporated herein by reference in its entirety.

REFERENCE SIGNS LIST

54 film thickness measuring machine
56 temperature sensor
102 polishing target
108 polishing pad
140 control unit
150 polishing unit
210 eddy current sensor
234 angle calculation unit
238 film thickness calculation unit
241 end point detector
300 polishing unit
1000 substrate processing apparatus
300A first polishing unit
310A polishing pad
320A polishing table
330A top ring

What is claimed is:

1. A polishing apparatus comprising:

a rotatable polishing table configured to hold a polishing pad having a polishing surface;

a top ring that presses a substrate to be polished against the polishing surface is configured to polish a conductive film on the substrate;

an eddy current sensor disposed in the polishing table and configured to generate an output; and a monitoring apparatus configured to monitor a film thickness of the conductive film based on an output of the eddy current sensor, wherein the output of the eddy current sensor includes an impedance component, where the impedance component includes a resistance component and a reactance component, the monitoring apparatus obtains film thickness information from the impedance component and is configured to calculate the film thickness from the film thickness information using correspondence information indicating a non-linear relationship between the film thickness information and the film thickness, when the resistance component and the reactance component of the impedance component are associated with the respective axes of a coordinate system having two orthogonal coordinate axes, the film thickness information is a reciprocal of a tangent of an impedance angle, which is an angle formed between a straight line connecting a point on the coordinate system corresponding to the impedance component and a predetermined reference point, and a predetermined straight line, and the monitoring apparatus is configured to calculate the impedance angle from the impedance component, and then calculate the film thickness information from the impedance angle.

2. The polishing apparatus according to claim 1, wherein the correspondence information includes information indicating that the film thickness is a quadratic function of the reciprocal.

3. The polishing apparatus according to claim 1, wherein the correspondence information includes information indicating that the film thickness is an exponential function of the reciprocal.

4. The polishing apparatus according to claim 1, further comprising:

a temperature sensor configured to directly or indirectly measure a temperature of the substrate under polishing; and a temperature correction unit configured to correct the obtained film thickness using the measured temperature.

* * * * *